US011001282B2

(12) United States Patent
Tsujita et al.

(10) Patent No.: US 11,001,282 B2
(45) Date of Patent: May 11, 2021

(54) RAIL STATE MONITORING APPARATUS

(71) Applicants: MITSUBISHI ELECTRIC CORPORATION, Chiyoda-ku (JP); MITSUBISHI ELECTRIC RESEARCH LABORATORIES, INC., Cambridge, MA (US)

(72) Inventors: Wataru Tsujita, Chiyoda-ku (JP); Kenzo Makino, Chiyoda-ku (JP); Atsushi Takami, Chiyoda-ku (JP); Bingnan Wang, Cambridge, MA (US)

(73) Assignees: MITSUBISHI ELECTRIC CORPORATION, Chiyoda-ku (JP); MITSUBISHI ELECTRIC RESEARCH LABORATORIES, INC., Cambridge, MA (US)

( * ) Notice: Subject to any disclaimer, the term of this patent is extended or adjusted under 35 U.S.C. 154(b) by 318 days.

(21) Appl. No.: 16/169,200

(22) Filed: Oct. 24, 2018

(65) Prior Publication Data

US 2020/0130717 A1 Apr. 30, 2020

(51) Int. Cl.
*B61L 23/04* (2006.01)
*B61L 1/10* (2006.01)
(Continued)

(52) U.S. Cl.
CPC ..... *B61L 23/044* (2013.01); *B61L 1/10* (2013.01); *B61L 3/12* (2013.01); *B61L 15/0027* (2013.01)

(58) Field of Classification Search
CPC ..... B61L 23/00; B61L 23/04; B61L 23/042; B61L 23/044; B61L 23/045; B61L 1/00; B61L 3/12; B61L 15/0027
See application file for complete search history.

(56) References Cited

U.S. PATENT DOCUMENTS

2016/0194012 A1 7/2016 Matthews et al.

FOREIGN PATENT DOCUMENTS

DE 10 2013 219 763 A1 8/2014
EP 3 095 667 A1 11/2016
(Continued)

OTHER PUBLICATIONS

International Search Report and Written Opinion of the International Searching Authority dated Jan. 8, 2020 in PCT/JP2019/028571, 19 pages.
(Continued)

*Primary Examiner* — Robert J McCarry, Jr.
(74) *Attorney, Agent, or Firm* — Oblon, McClelland, Maier & Neustadt, L.L.P.

(57) ABSTRACT

A rail state monitoring apparatus (1) includes: first and second transmission antennas (101, 102) to transmit first and second electric signals to rails (5, 6), respectively; first reception antenna (201) to receive a surface wave (21) of the first electric signal propagated through rail (5) and guided wave (32) of the second electric signal propagated through loop coil (10); second reception antenna (202) to receive surface wave (22) of the second electric signal propagated through rail (6) and guided wave (31) of the first electric signal propagated through loop coil (10); and a processor. The processor obtains received powers of the respective electric signals received by first and second reception antennas (201, 202), determines a rail state from "good", "rail broken", "rail crack", or "rail surface anomaly" based on the received powers, and outputs the rail state as rail state information.

9 Claims, 25 Drawing Sheets

(51) Int. Cl.
*B61L 3/12* (2006.01)
*B61L 15/00* (2006.01)

(56) References Cited

FOREIGN PATENT DOCUMENTS

| | | | | |
|---|---|---|---|---|
| EP | 3095667 A1 * | 11/2016 | ..... | B61L 27/0088 |
| JP | 2002-294609 | 10/2002 | | |

OTHER PUBLICATIONS

Plotnikov, Y. et. al., "Development of the Electromagnetic Technology for Broken Rail Detection from a Mobil Platform",42$^{nd}$ Annual Review of Progress in Quantitative Nondestructive Evaluation, AIP Conference Proceedings 1706, 2016, pp. 8.

* cited by examiner

| Rail State | Rx201 | | Rx202 | |
|---|---|---|---|---|
| | Tx101 signal | Tx102 signal | Tx101 signal | Tx102 signal |
| good (normal) | high | high | high | high |
| Rail5 broken | low | low | low | high |
| Rail 5 crack | mid | mid | mid | high |
| Rail 5 surface anomaly | high | low | low | high |
| Rail6 broken | high | low | low | Low |
| Rail 6 crack | high | mid | mid | mid |
| Rail 6 surface anomaly | high | low | low | high |

FIG. 11

| Rail State | Rx201 | | Rx202 | |
|---|---|---|---|---|
| | Tx101signal | Tx102 signal | Tx101signal | Tx102 signal |
| good (normal) | high | high | high | high |
| Rail5 broken | low | low | low | high |
| Rail 5 crack | mid | mid | mid | high |
| Rail 5 surface anomaly | high | low | low | high |
| Rail6 broken | high | low | low | low |
| Rail 6 crack | high | mid | mid | mid |
| Rail 6 surface anomaly | high | low | low | high |
| Tx101 broken | low | high | low | high |
| Tx102 broken | high | low | high | low |
| Rx201 broken | low | low | high | high |
| Rx202 broken | high | high | low | low |
| Wheel anomaly | high | low | low | high |

FIG. 17

| Rail State | Rx201 | | Rx202 | | Running distance |
|---|---|---|---|---|---|
| | Tx101signal | Tx102 signal | Tx101signal | Tx102 signal | |
| good (normal) | high | high | high | high | ≥L1 |
| Rail5 broken | low | low | low | high | single drop in L1 |
| Rail 5 crack | mid | mid | mid | high | single drop in L1 |
| Rail 5 surface anomaly | high | low | low | high | two drops in L2 |
| Rail6 broken | high | low | low | Low | single drop in L1 |
| Rail 6 crack | high | mid | mid | mid | single drop in L1 |
| Rail 6 surface anomaly | high | low | low | high | two drops in L2 |
| Tx101 broken | low | high | low | high | ≥L1 |
| Tx102 broken | high | low | High | Low | ≥L1 |
| Rx201broken | low | low | high | high | ≥L1 |
| Rx202 broken | high | high | low | low | ≥L1 |
| Wheel anomaly | high | low | low | high | ≥L1 |

FIG. 19

| BLOCK NUMBER | VIRTUAL TRACK CIRCUIT |
|---|---|
| B1001 | 1T |
| B1002 | 2T |
| B1003 | 2T |
| B1004 | 2T |
| B1005 | 2T |
| : | : |

ONE VIRTUAL TRACK CIRCUIT MAY BE ASSIGNED TO PLURALITY OF BLOCKS

| Rail State | Rx201 | Rx202 | Running distance |
|---|---|---|---|
| | Tx101signal | Tx101 signal | |
| good (normal) | high | high | ≥L1 |
| Rail5 broken | low | low | single drop in L1 |
| Rail 5 crack | mid | mid | singledrop in L1 |
| Rail 5 surface anomaly | high | low | two drops in L2 |
| Rail6 broken | high | low | single drop in L1 |
| Rail 6 crack | high | mid | Single drop in L1 |
| Rail 6 surface anomaly | high | low | two drops in L2 |
| Tx101 broken | low | low | ≥L1 |
| Rx201 broken | low | high | ≥L1 |
| Rx202 broken | high | low | ≥L1 |
| Wheel anomaly | high | low | ≥L1 |

FIG.31

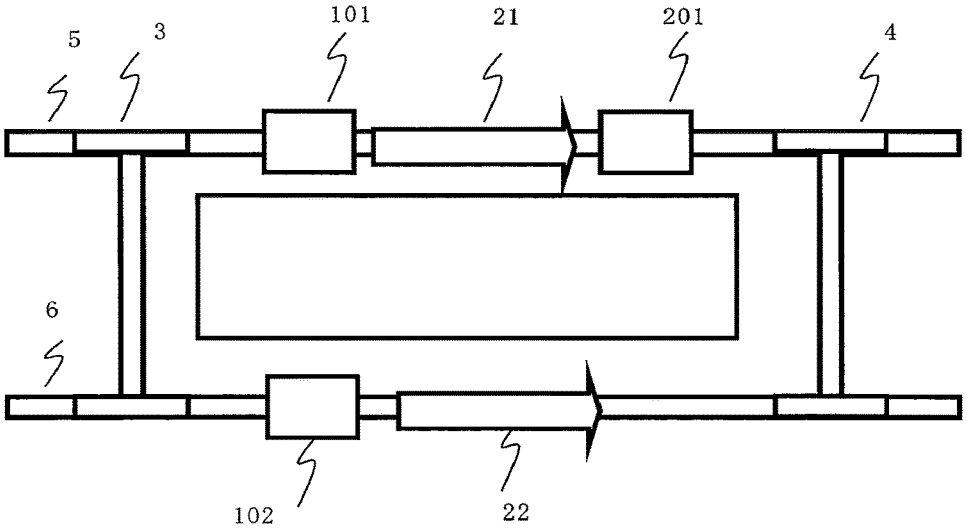

FIG.32

| Rail State | Rx201 | | Running distance |
|---|---|---|---|
| | Tx101signal | Tx102signal | |
| good (normal) | high | high | ≥L1 |
| Rail5 broken | low | low | single drop in L1 |
| Rail 5 crack | mid | mid | single drop in L1 |
| Rail 5 surface anomaly | high | low | two drops in L2 |
| Rail6 broken | high | low | single drop in L1 |
| Rail 6 crack | high | mid | singledrop in L1 |
| Rail 6 surface anomaly | high | low | two drops in L2 |
| Tx101 broken | low | high | ≥L1 |
| Tx102 broken | high | low | ≥L1 |
| Rx201 broken | low | low | ≥L1 |
| Wheel anomaly | high | low | ≥L1 |

FIG.33

RAIL STATE MONITORING APPARATUS

BACKGROUND OF THE INVENTION

1. Field of the Invention

The present invention relates to a rail state monitoring apparatus for detecting a state of a rail.

2. Description of the Related Art

A related-art rail state monitoring apparatus described in Japanese Patent Application Laid-open No. 2002-294609 includes a signal transmitter, a processor, and a signal receiver. An electric signal transmitted from the signal transmitter is input to a first axle disposed on the front side of a vehicle. The electric signal input to the first axle is propagated to a second axle disposed on the rear side of the vehicle through left and right rails. The electric signal propagated to the second axle is received by the signal receiver. The processor constantly accumulates a received power of the electric signal received by the signal receiver. The processor determines that a rail breakage has occurred when the received power drops.

In the rail state monitoring apparatus disclosed in Japanese Patent Application Laid-open No. 2002-294609, the processor determines whether a rail breakage has occurred based on the received power of the electric signal that has been propagated through the rails. However, when rust on a rail or other such rail surface anomaly has occurred, there is a fear that an electrical contact failure may occur between a rail and a wheel. Even in such a case, an electric signal is not propagated, which leads to a problem that the processor cannot distinguish between a rail surface anomaly and a rail breakage, to thereby erroneously determine that a rail breakage has occurred.

SUMMARY OF THE INVENTION

The present invention has been made in order to solve the above-mentioned problem, and has an object to obtain a rail state monitoring apparatus that suppresses erroneous determination as a rail breakage.

According to one embodiment of the present invention, a rail state monitoring apparatus is provided, including: a transmission antenna, which is disposed on a vehicle, and is configured to transmit at least one of a first electric signal, which is to be transmitted to a first rail of a pair of rails, or a second electric signal, which is to be transmitted to a second rail of the pair of rails; a reception antenna, which is disposed on the vehicle, and is configured to receive: at least one of the first electric signal propagated through the first rail or the second electric signal propagated through the second rail; and at least one of the first electric signal propagated through an annular transmission line formed so as to include the first rail and the second rail or the second electric signal propagated through the annular transmission line; and a processor, wherein the processor is configured to: set a first threshold value and a second threshold value smaller than the first threshold value in advance; calculate received powers of the first electric signal and the second electric signal, which are received by the reception antenna; classify each of the received powers as one of three levels of "high", "medium", and "low" in comparison with the first threshold value and the second threshold value, and generate a received power pattern; and determine each of rail states of the first rail and the second rail as at least anyone of "good", "rail broken", "rail crack", or "rail surface anomaly" based on the generated received power pattern, and output a result of the determination as rail state information.

With the rail state monitoring apparatus according to one embodiment of the present invention, it is possible to suppress erroneous determination as a rail breakage.

BRIEF DESCRIPTION OF THE DRAWINGS

FIG. 11 is a table for showing a determination table for the rail state monitoring apparatus according to the first embodiment of the present invention.

FIG. 17 is a table for showing a determination table for the rail state monitoring apparatus according to the second embodiment of the present invention.

FIG. 19 is a table for showing a determination table for the rail state monitoring apparatus according to the second embodiment of the present invention.

FIG. 31 is a table for showing a determination table for the rail state monitoring apparatus according to the fifth embodiment of the present invention.

FIG. 32 is a diagram for illustrating a propagation path of an electric signal exhibited in the rail state monitoring apparatus according to the fifth embodiment of the present invention.

FIG. 33 is a table for showing a determination table for the rail state monitoring apparatus according to the fifth embodiment of the present invention.

DESCRIPTION OF THE EMBODIMENTS

Figure 1:
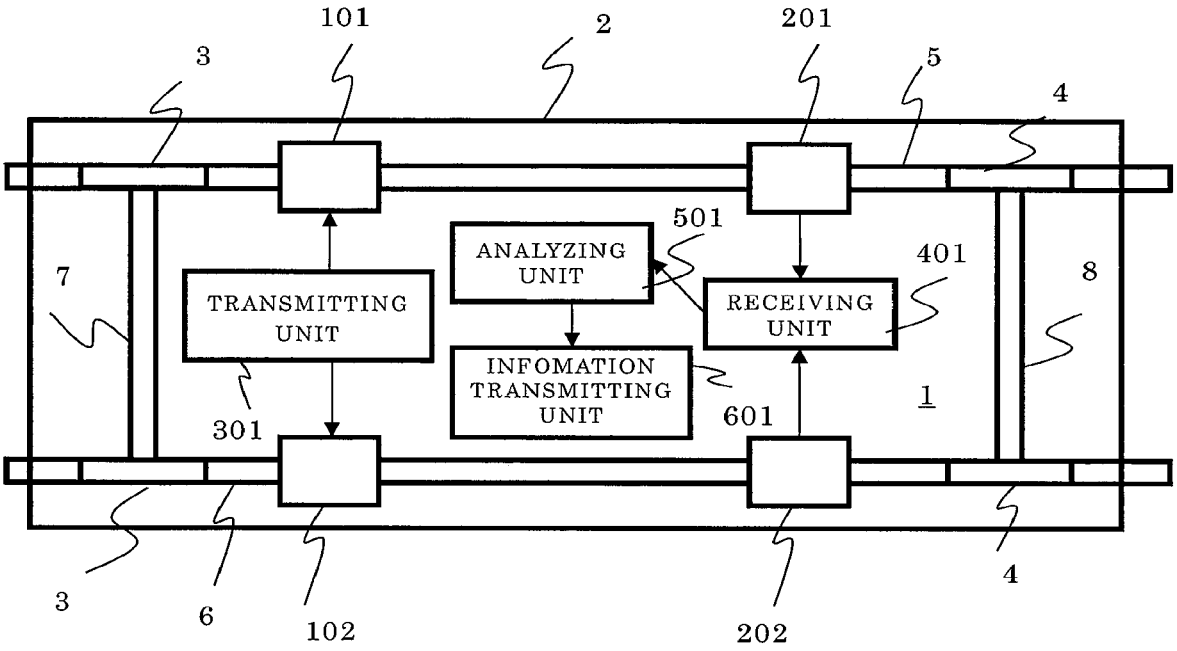
FIG. 1 is a configuration diagram for illustrating a configuration of a rail state monitoring apparatus according to a first embodiment of the present invention.

In the following description, like components are denoted by like reference numerals/symbols.

First Embodiment

Figure 2:
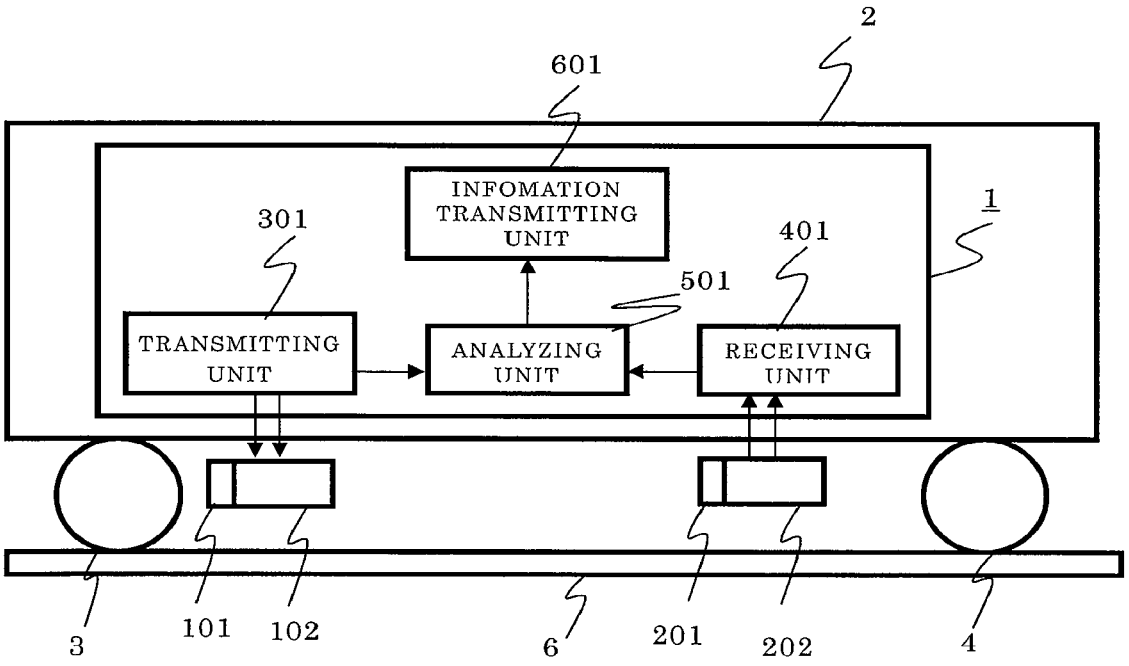
FIG. 2 is a configuration diagram for illustrating the configuration of the rail state monitoring apparatus according to the first embodiment of the present invention.

FIG. 1 and FIG. 2 are diagrams for schematically illustrating a configuration of a rail state monitoring apparatus 1 according to a first embodiment of the present invention. FIG. 1 is a plan view, and FIG. 2 is a side view.

As illustrated in FIG. 1 and FIG. 2, the rail state monitoring apparatus 1 is mounted to a vehicle 2, for example, a railway vehicle. The vehicle 2 includes a pair of front wheels 3 and a pair of rear wheels 4. The vehicle 2 uses the front wheels 3 and the rear wheels 4 to travel on two rails 5 and 6. The rail 5 and the rail 6 are laid in parallel with each other across a gap set in advance. The pair of front wheels 3 are coupled to each other via a wheel axle 7 so as to fit the gap between the rail 5 and the rail 6. In the same manner, the pair of rear wheels 4 are coupled to each other via a wheel axle 8 so as to fit the gap between the rail 5 and the rail 6. The vehicle 2 is coupled to at least one other vehicle 2 to travel as a train.

The rail state monitoring apparatus 1 includes a first transmission antenna 101, a second transmission antenna 102, a first reception antenna 201, a second reception antenna 202, a transmitting unit 301, a receiving unit 401, an analyzing unit 501, and an information transmitting unit 601.

The first transmission antenna 101, the second transmission antenna 102, the first reception antenna 201, and the second reception antenna 202 are mounted under the floor of the vehicle 2 so as to be located between the front wheels 3 and the rear wheels 4.

The first transmission antenna 101 and the first reception antenna 201 are mounted above the rail 5 along a longitudinal direction of the rail 5 with an interval set in advance. In the same manner, the second transmission antenna 102 and the second reception antenna 202 are mounted above the rail 6 along a longitudinal direction of the rail 6 with an interval set in advance.

The first transmission antenna 101 transmits an electric signal to the rail 5. The second transmission antenna 102 transmits an electric signal to the rail 6. Meanwhile, the first reception antenna 201 receives the electric signal propagated through the rail 5 or the electric signal propagated through an annular transmission line formed so as to include the rail 5 and the rail 6. The second reception antenna 202 receives the electric signal propagated through the rail 6 or the electric signal propagated through the annular transmission line formed so as to include the rail 5 and the rail 6.

The transmitting unit 301 is connected to the first transmission antenna 101 and the second transmission antenna 102. The transmitting unit 301 generates a first electric signal to output the first electric signal to the first transmission antenna 101, and generates a second electric signal to output the second electric signal to the second transmission antenna 102.

The receiving unit 401 is connected to the first reception antenna 201 and the second reception antenna 202. The receiving unit 401 calculates received powers and phases of the first electric signal and the second electric signal, which are received by the first reception antenna 201 and the second reception antenna 202. The receiving unit 401 may calculate only the received powers, or may calculate only the phases.

The analyzing unit 501 is connected to the receiving unit 401. The analyzing unit 501 compares the received powers calculated by the receiving unit 401 with two threshold values, to thereby classify the received powers into three levels of "high", "medium", and "low" to generate a received power pattern. The analyzing unit 501 determines the states of the rail 5 and the rail 6 based on the generated received power pattern. The analyzing unit 501 outputs the determined rail state as rail state information.

The information transmitting unit 601 is connected to the analyzing unit 501. The information transmitting unit 601 transmits the rail state information received from the analyzing unit 501 to a ground apparatus disposed in the outside. The ground apparatus is described later in a third embodiment of the present invention.

The mounting positions of the transmitting unit 301, the receiving unit 401, the analyzing unit 501, and the information transmitting unit 601 may be freely-selected positions located in the vehicle 2, and are not particularly limited.

Next, an operation of the rail state monitoring apparatus 1 according to the first embodiment is described.

The transmitting unit 301 generates a first electric signal of a first frequency and a first amplitude, which are set in advance, and outputs the first electric signal to the first transmission antenna 101. Meanwhile, the transmitting unit 301 generates a second electric signal of a second frequency and a second amplitude, which are set in advance, and outputs the second electric signal to the second transmission antenna 102.

At this time, the transmitting unit 301 employs a multiplexing technology for the first electric signal and the second electric signal so as to prevent the first electric signal and the second electric signal from interfering with each other. Specifically, the first frequency of the first electric signal and the second frequency of the second electric signal are set to have frequency values different from each other. In another case, the transmitting unit 301 subjects the first electric signal and the second electric signal to code modulation or frequency modulation through use of codes different from each other. In further another case, the transmitting unit 301 controls the first transmission antenna 101 and the second transmission antenna 102 to transmit the first electric signal and the second electric signal by time division. The multiplexing technology is not limited to those technologies, and another multiplexing technology may be employed.

When received the input of the first electric signal from the transmitting unit 301, the first transmission antenna 101 outputs the first electric signal to the rail 5. When receiving the input of the second electric signal from the transmitting unit 301, the second transmission antenna 102 outputs the second electric signal to the rail 6. As a result, the first electric signal is propagated through the rail 5, and the second electric signal is propagated through the rail 6. At this time, a propagation path is changed between a case in which the rail 5 and the rail 6 are in a good state and a case in which an anomaly of some kind has occurred in the rail 5 or the rail 6. Details thereof are described below.

Figure 3:
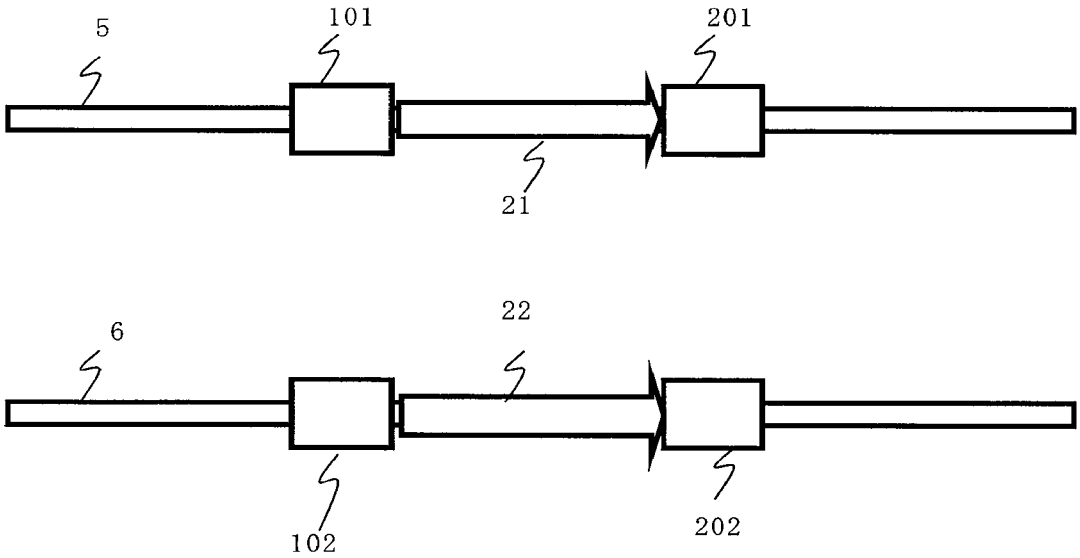
FIG. 3 is a diagram for illustrating a propagation path of an electric signal exhibited in the rail state monitoring apparatus according to the first embodiment of the present invention.
Figure 4:
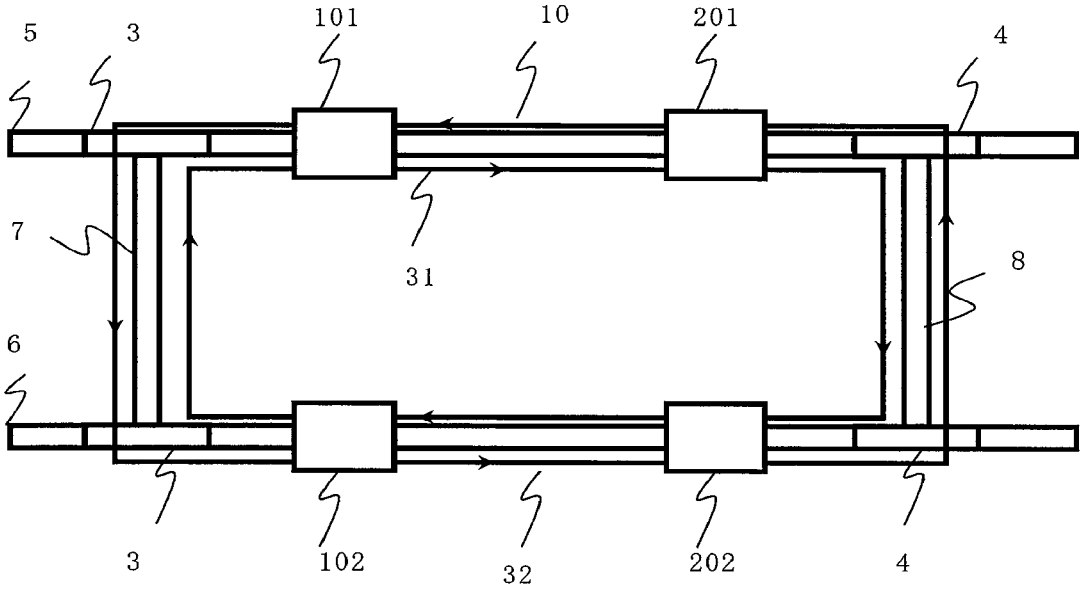
FIG. 4 is a diagram for illustrating a propagation path of an electric signal exhibited in the rail state monitoring apparatus according to the first embodiment of the present invention.

First, a description is given for propagation paths of the first electric signal and the second electric signal exhibited when the rail 5 and the rail 6 are in a good state. FIG. 3 and FIG. 4 are each an explanatory diagram of a propagation path of an electric signal exhibited when the rails are in a good state. A propagation behavior of the first electric signal and a propagation behavior of the second electric signal are basically the same, and hence the following description is given mainly for the first electric signal.

When receiving the input of the first electric signal from the transmitting unit 301, the first transmission antenna 101 outputs the first electric signal to the rail 5. At this time, waves in two different propagation modes are propagated through the rail 5. The wave in one propagation mode is illustrated in FIG. 3, and the wave in the other propagation mode is illustrated in FIG. 4.

As illustrated in FIG. 3, the wave in the one propagation mode is a surface wave 21 propagated on the rail 5. In the following description, the surface wave 21 propagated on the rail 5 is referred to as "first surface wave 21", and a surface wave propagated on the rail 6 is referred to as "second surface wave 22". The first surface wave 21 is a surface wave corresponding to the first electric signal, and is propagated on the rail 5 without being propagated on the rail 6. The second surface wave 22 is a surface wave corresponding to the second electric signal, and is propagated on the rail 6 without being propagated on the rail 5.

Meanwhile, as illustrated in FIG. 4, the wave in the other propagation mode is a guided wave propagated through a loop coil 10. The loop coil 10 is an annular transmission line including the rail 5, the rail 6, the wheel axle 7, and the wheel axle 8. In the following description, the guided wave corresponding to the first electric signal output from the first transmission antenna 101 is referred to as "first guided wave 31", and the guided wave corresponding to the second electric signal output from the second transmission antenna 102 is referred to as "second guided wave 32".

When a rail breakage, rust, or other such rail surface anomaly has occurred in the rail 5 or the rail 6, a contact failure occurs between the wheels 3 and 4 and the rails 5 or 6. As a result, the loop coil 10 is disconnected, or an impedance of the loop coil 10 is changed. Therefore, propagation states of the surface wave 21 and the surface wave 22 and propagation states of the guided wave 31 and the guided wave 32 are changed. In the first embodiment, the analyzing unit 501 detects the changes of the propagation states, to determine the states of the rail 5 and the rail 6.

The first electric signal is propagated on the rail 5 as the first surface wave 21 as illustrated in FIG. 3, and is propagated through the loop coil 10 as the first guided wave 31 as illustrated in FIG. 4.

The first surface wave 21 is propagated on the rail 5 to reach a location at which the first reception antenna 201 is mounted. Meanwhile, the first guided wave 31 is propagated through the loop coil 10 to reach not only the location at which the first reception antenna 201 is mounted but also a location at which the second reception antenna 202 is mounted.

In the same manner, the second electric signal output from the second transmission antenna 102 is propagated on the rail 6 as the second surface wave 22 as illustrated in FIG. 3, and is propagated through the loop coil 10 as the second guided wave 32 as illustrated in FIG. 4.

The second surface wave 22 is propagated on the rail 6 to reach a location at which the second reception antenna 201 is mounted. Meanwhile, the second guided wave 32 is propagated through the loop coil 10 to reach not only the location at which the second reception antenna 202 is mounted but also a location at which the first reception antenna 201 is mounted.

The first reception antenna 201 is mounted so as to receive the electric signal propagated through the rail 5. Therefore, the first reception antenna 201 receives the first electric signal propagated as the first surface wave 21 and the first guided wave 31 and the second electric signal propagated as the second guided wave 32, and outputs the first electric signal and the second electric signal to the receiving unit 401.

The second reception antenna 202 is mounted so as to receive the electric signal propagated through the rail 6. Therefore, the second reception antenna 202 receives the second electric signal propagated as the second surface wave 22 and the second guided wave 32 and the first electric signal propagated as the first guided wave 31, and outputs the first electric signal and the second electric signal to the receiving unit 401.

The receiving unit 401 calculates the received powers of the first electric signal and the second electric signal, which are received by the first reception antenna 201, and the received powers of the first electric signal and the second electric signal, which are received by the second reception antenna 202.

The analyzing unit 501 compares the received powers calculated by the receiving unit 401 with two threshold values, to thereby classify the received powers into the three levels of "high", "medium", and "low" to generate a received power pattern.

The received power pattern at a time of a good state is as follows.

First reception antenna 201: first electric signal: high

First reception antenna 201: second electric signal: high

Second reception antenna 202: first electric signal: high

Second reception antenna 202: second electric signal: high

The analyzing unit 501 generates a received power pattern of "high, high, high, and high" by arranging the levels of the received powers of those four electric signals in order, and determines that the rail states of the rail 5 and the rail 6 are good based on the received power pattern.

Figure 5:
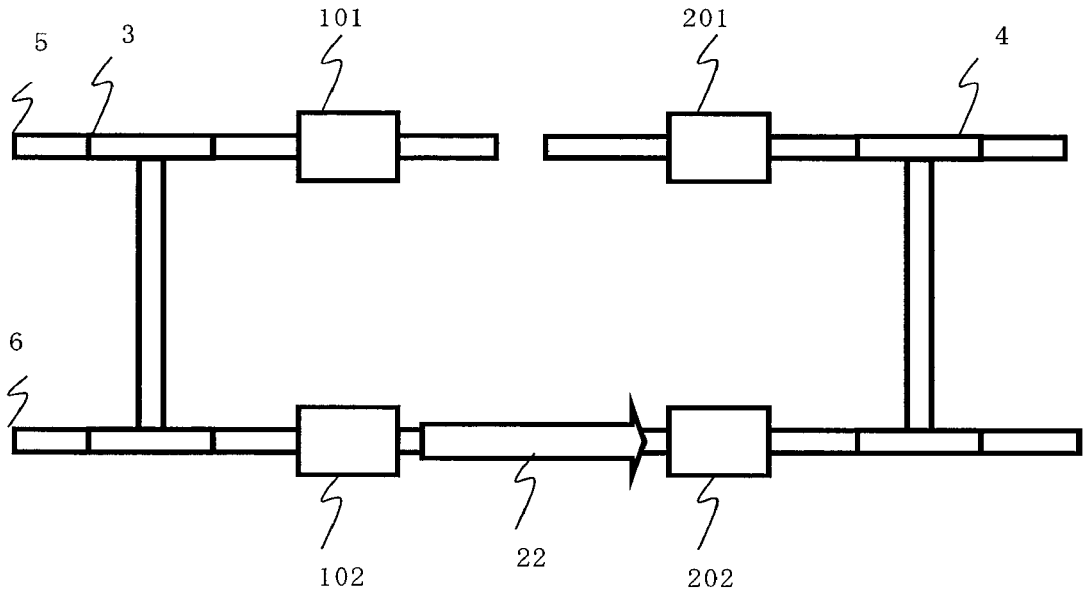
FIG. 5 is a diagram for illustrating a propagation path of an electric signal exhibited in the rail state monitoring apparatus according to the first embodiment of the present invention.

Next, with reference to FIG. 5, a description is given for a propagation path of an electric signal exhibited when a breakage has occurred in the rail 5. FIG. 5 is an explanatory diagram of a propagation path of an electric signal exhibited when a breakage has occurred in the rail 5.

As illustrated in FIG. 5, when receiving the input of the first electric signal, the first transmission antenna 101 outputs the first electric signal to the rail 5. The first electric signal is propagated through the rail 5 as the first surface wave 21. However, a breakage has occurred in the rail 5, which inhibits the first surface wave 21 from reaching the location at which the first reception antenna 201 is mounted. The loop coil 10 is also disconnected in the middle due to the breakage of the rail 5, which also inhibits the first guided wave 31 from being propagated to reach the location at which the second reception antenna 202 is mounted.

When receiving the input of the second electric signal, the second transmission antenna 102 outputs the second electric signal to the rail 6. The second electric signal is propagated through the rail 6 as the second surface wave 22 to reach the location at which the second reception antenna 202 is mounted. However, the loop coil 10 is also disconnected in the middle due to the breakage of the rail 5, which inhibits the second guided wave 32 from being propagated to reach the location at which the first reception antenna 201 is mounted.

Therefore, the first reception antenna 201 receives neither the first electric signal nor the second electric signal, and hence outputs a signal for notifying a non-reception state to the receiving unit 401.

Further, the second reception antenna 202 receives only the second electric signal propagated as the second surface wave 22, and outputs only the second electric signal to the receiving unit 401.

Therefore, the received power pattern generated by the analyzing unit 501 is as follows.

First reception antenna 201: first electric signal: low

First reception antenna 201: second electric signal: low

Second reception antenna 202: first electric signal: low

Second reception antenna 202: second electric signal: high

The analyzing unit 501 determines that a breakage has occurred in the rail 5 with the rail 6 being good based on a received power pattern of "low, low, low, and high".

Figure 6:
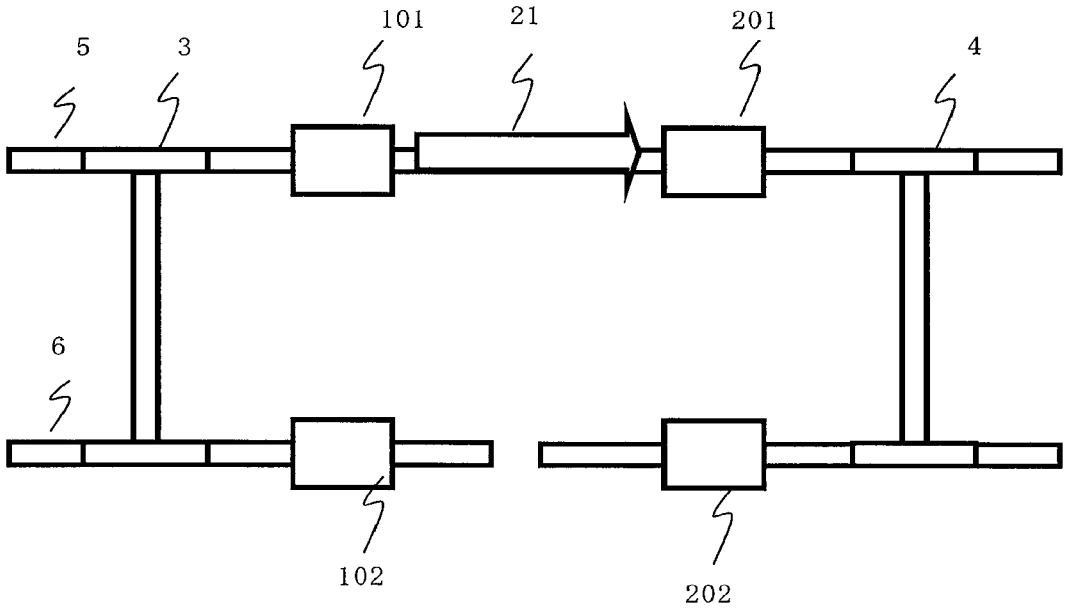
FIG. 6 is a diagram for illustrating a propagation path of an electric signal exhibited in the rail state monitoring apparatus according to the first embodiment of the present invention.

Next, with reference to FIG. 6, a description is given for an electric signal obtained when a breakage has occurred in the rail 6. FIG. 6 is an explanatory diagram of a propagation path of an electric signal exhibited when a breakage has occurred in the rail 6. Even when a breakage has occurred in the rail 6, the electric signal is propagated under the same rule as when a breakage has occurred in the rail 5.

Accordingly, the first reception antenna 201 receives only the first electric signal propagated as the first surface wave 21, and outputs only the first electric signal to the receiving unit 401.

Further, the second reception antenna 202 receives neither the first electric signal nor the second electric signal, and hence outputs a signal for notifying a non-reception state to the receiving unit 401.

Therefore, the received power pattern generated by the analyzing unit 501 is as follows.

First reception antenna 201: first electric signal: high

First reception antenna 201: second electric signal: low

Second reception antenna 202: first electric signal: low

Second reception antenna 202: second electric signal: low

The analyzing unit 501 determines that a breakage has occurred in the rail 6 with the rail 5 being good based on a received power pattern of "high, low, low, and low".

Figure 7:
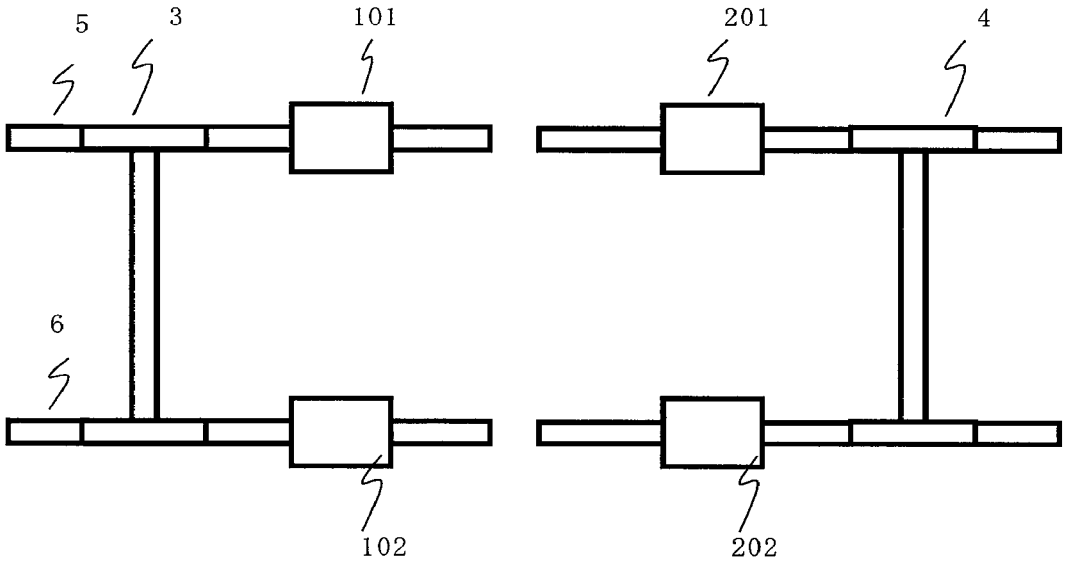
FIG. 7 is a diagram for illustrating a propagation path of an electric signal exhibited in the rail state monitoring apparatus according to the first embodiment of the present invention.

Next, with reference to FIG. 7, a description is given for an electric signal obtained when a breakage has occurred in both the rail 5 and the rail 6. At this time, none of the first surface wave 21, the second surface wave 22, the first guided wave 31, and the second guided wave 32 is propagated to reach the first reception antenna 201 and the second reception antenna 202.

Therefore, the first reception antenna 201 receives neither the first electric signal nor the second electric signal, and hence outputs a signal for notifying a non-reception state to the receiving unit 401.

Similarly, the second reception antenna 202 receives neither the first electric signal nor the second electric signal, and hence outputs a signal for notifying a non-reception state to the receiving unit 401.

Accordingly, the received power pattern generated by the analyzing unit 501 is as follows.

First reception antenna 201: first electric signal: low

First reception antenna 201: second electric signal: low

Second reception antenna 202: first electric signal: low

Second reception antenna 202: second electric signal: low

The analyzing unit 501 determines that a breakage has occurred in the rail 5 and the rail 6 based on a received power pattern of "low, low, low, and low".

Figure 8:
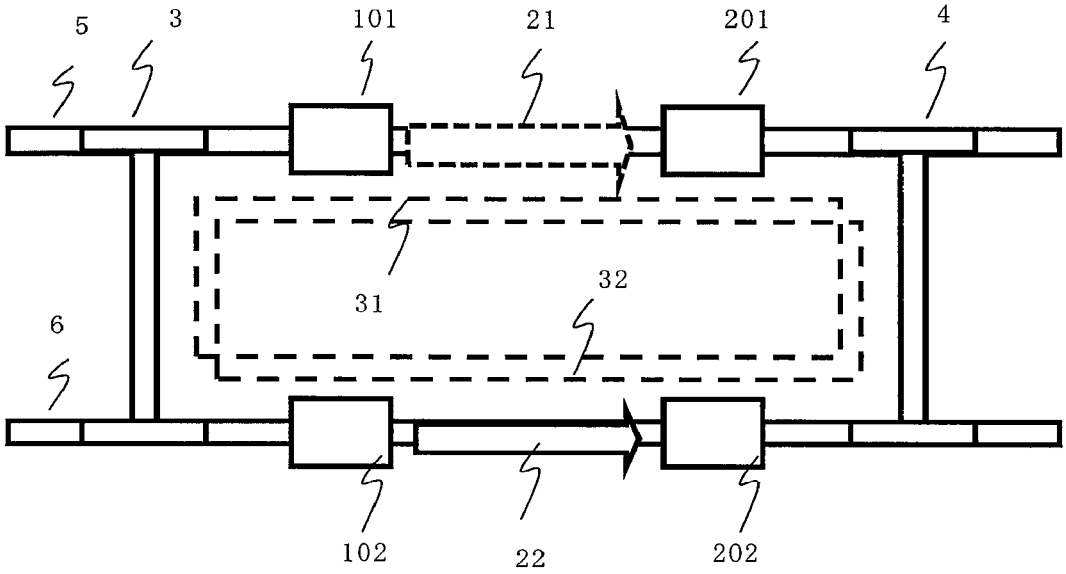
FIG. 8 is a diagram for illustrating a propagation path of an electric signal exhibited in the rail state monitoring apparatus according to the first embodiment of the present invention.

Next, with reference to FIG. 8, a description is given for a propagation path of an electric signal exhibited when a crack has occurred in the rail 5. At this time, a resistance value of the rail 5 becomes higher than in the good state due to the occurrence of a crack in the rail 5. The first surface wave 21 propagated through the rail 5 has a propagation loss larger than in the good rail state due to an increase in resistance value and scattering at a cracked spot. A resistance value of the loop coil 10 also becomes larger than when the rail is good due to the crack in the rail 5. Therefore, a propagation loss of each of the first guided wave 31 and the second guided wave 32 becomes larger than in the good rail state.

The first reception antenna 201 receives the first electric signal and the second electric signal, and outputs the first electric signal and the second electric signal to the receiving unit 401. The second reception antenna 202 receives the first electric signal and the second electric signal and outputs the first electric signal and the second electric signal to the receiving unit 401. At this time, the received power of the second electric signal propagated as the second surface wave 22 to reach the second reception antenna 202 is the same as at the time of a good state. However, the received power of the other electric signals become smaller than when the rail is good due to an influence of the crack in the rail 5, but is larger than the received power exhibited when a breakage has occurred in the rail 5.

Therefore, the received power pattern generated by the analyzing unit 501 is as follows.

First reception antenna 201: first electric signal: medium

First reception antenna 201: second electric signal: medium

Second reception antenna 202: first electric signal: medium

Second reception antenna 202: second electric signal: high

The analyzing unit 501 determines that a crack has occurred in the rail 5 with the rail 6 being good based on a received power pattern of "medium, medium, medium, and high".

Figure 9:
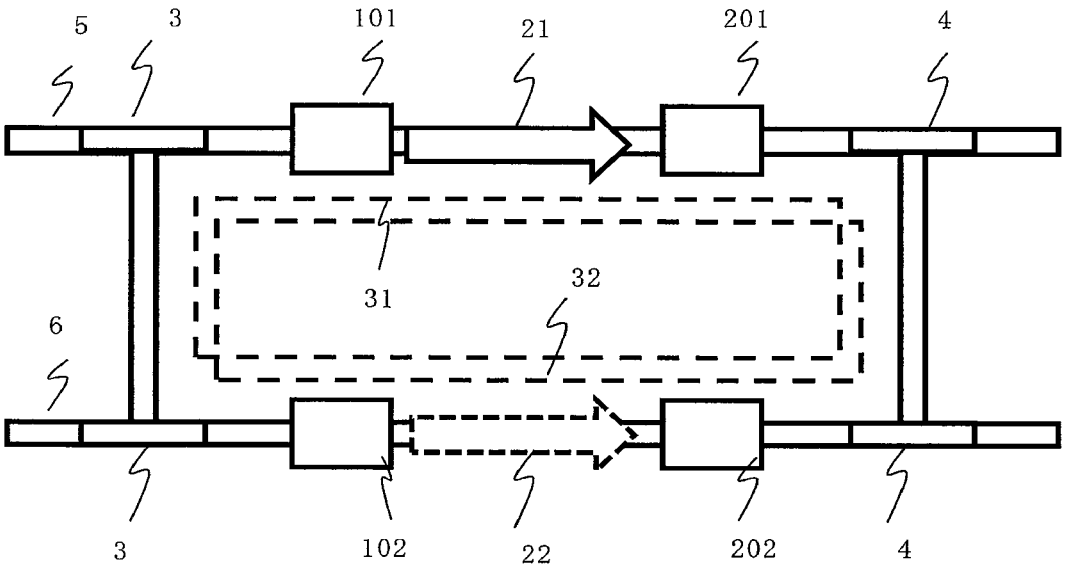
FIG. 9 is a diagram for illustrating a propagation path of an electric signal exhibited in the rail state monitoring apparatus according to the first embodiment of the present invention.

Next, with reference to FIG. 9, a description is given for a propagation path of an electric signal exhibited when a crack has occurred in the rail 6. At this time, a resistance value of the rail 6 becomes higher than in the good state. The second surface wave 22 propagated through the rail 6 has a propagation loss larger than in the good rail state due to an increase in resistance value and scattering at a cracked spot. A resistance value of the loop coil 10 also becomes larger than when the rail is good due to the crack in the rail 6. Therefore, a propagation loss of each of the first guided wave 31 and the second guided wave 32 becomes larger than in the good rail state.

The first reception antenna 201 receives the first electric signal and the second electric signal, and outputs the first electric signal and the second electric signal to the receiving unit 401. The second reception antenna 202 receives the first electric signal and the second electric signal and outputs the first electric signal and the second electric signal to the receiving unit 401. At this time, the received power of the first electric signal propagated as the first surface wave 21 to reach the first reception antenna 201 is the same as at the time of a good state. However, the received power of the other electric signals become smaller than when the rail is good due to an influence of the crack in the rail 6, but is larger than the received power exhibited when a breakage has occurred in the rail 6.

Therefore, the received power pattern generated by the analyzing unit 501 is as follows.

First reception antenna 201: first electric signal: high

First reception antenna 201: second electric signal: medium

Second reception antenna 202: first electric signal: medium

Second reception antenna 202: second electric signal: medium

The analyzing unit 501 determines that a crack has occurred in the rail 6 with the rail 5 being good based on a received power pattern of "high, medium, medium, and medium".

Figure 10:
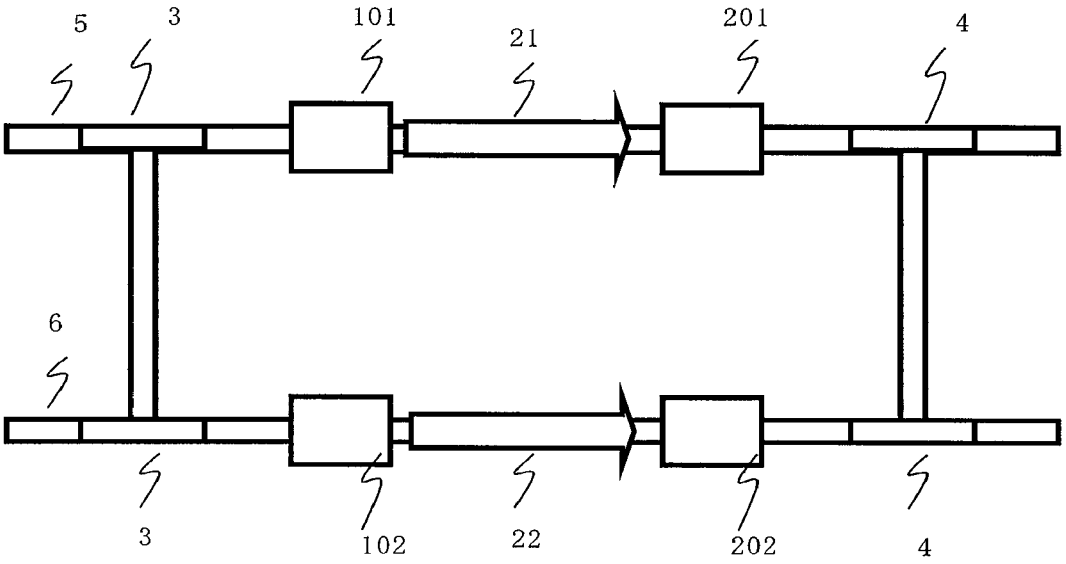
FIG. 10 is a diagram for illustrating a propagation path of an electric signal exhibited in the rail state monitoring apparatus according to the first embodiment of the present invention.

Next, with reference to FIG. 10, a description is given for a case in which rust or foreign matter has adhered to a rail surface of one or both of the rail 5 and the rail 6. FIG. 10 is an explanatory diagram of a propagation path of an electric signal exhibited when rust or foreign matter has adhered to the surface of the rail 5. In the following description, the adhesion of rust or foreign matter is referred to as "rail surface anomaly", and a spot at which a rail surface anomaly has occurred is referred to as "anomaly spot".

In FIG. 10, when the wheel 3 passes the anomaly spot on the rail 5, an electrical contact failure occurs between the wheels 3 and the rail 5. Due to the occurrence of an electrical contact failure, the loop coil 10 is disconnected or the impedance of the loop coil 10 is changed, and hence the first guided wave 31 and the second guided wave 32 are not propagated, or energy of propagation becomes smaller than when the rail is good. However, the rail 5 is not broken, and hence the first surface wave 21 is propagated to reach the first reception antenna 201, while the second surface wave 22 is propagated to reach the second reception antenna 202.

The first reception antenna 201 receives the first electric signal propagated as the first surface wave 21, and outputs the first electric signal to the receiving unit 401.

The second reception antenna 202 receives the second electric signal propagated as the second surface wave 22, and outputs the second electric signal to the receiving unit 401.

Therefore, the received power pattern generated by the analyzing unit 501 is as follows.

First reception antenna 201: first electric signal: high

First reception antenna 201: second electric signal: low

Second reception antenna 202: first electric signal: low

Second reception antenna 202: second electric signal: high

The analyzing unit 501 determines that a surface anomaly has occurred in at least any one of the rail 5 or the rail 6 based on a received power pattern of "high, low, low, and high".

In this manner, the analyzing unit 501 subjects the received powers of the first electric signal and the second electric signal to determination using threshold values. The analyzing unit 501 determines the rail states based on results of the determination using the threshold values. With this determination, the analyzing unit 501 determines the presence or absence of a rail breakage of any one of the rail 5 and the rail 6, rail breakages of both the rail 5 and the rail 6, a rail crack, and a rail surface anomaly, and outputs the determination result to the information transmitting unit 601 as rail state information.

The description given above is an example of determining the rail state through use of the received power by the analyzing unit 501. However, the present invention is not limited thereto, and the phases of the first electric signal and the second electric signal may be used to determine the rail states. In addition, both the received powers and the phases of the first electric signal and the second electric signal may be used to determine the rail states.

FIG. 11 is a table for showing a determination table obtained when the received powers are used for determination. In the determination table, the received power patterns for the rail states are stored on a one-to-one basis.

As described above, the analyzing unit 501 uses two threshold values to classify the received powers into the three levels of "high", "medium", and "low". That is, a first threshold value Th1 and a second threshold value Th2 smaller than the first threshold value Th1 are set in advance. In this case, a received power equal to or larger than the first threshold value Th1 is set to be "high", a received power equal to or larger than the second threshold value Th2 but smaller than the first threshold value Th1 is set to be "medium", and a received power smaller than the second threshold value Th2 is set to be "low".

As shown in the determination table of FIG. 11, at the time of a good state, the received powers of the first electric signal and the second electric signal are all "high" at both the first reception antenna 201 and the second reception antenna 202, and hence the received power pattern exhibited at that time is "high, high, high, and high". Therefore, when the received powers of the first electric signal and the second electric signal are all "high" at both the first reception antenna 201 and the second reception antenna 202, the analyzing unit 501 generates a received power pattern of "high, high, high, and high". Then, the analyzing unit 501 searches the table of FIG. 11 for a received power pattern that matches the generated received power pattern to determine that the rail state is "good".

Meanwhile, when the rail 5 is broken, the received power of the second electric signal received by the second reception antenna 202 is "high", but the other received powers are all "low". Therefore, the analyzing unit 501 searches the table of FIG. 11 for a received power pattern that matches the received power pattern of "low, low, low, and high" to determine that the rail state is "Rail 5 broken".

Further, when the rail 5 is cracked, the received power of the second electric signal received by the second reception antenna 202 is "high", but the other received powers are all "medium". Therefore, the analyzing unit 501 searches the table of FIG. 11 for a received power pattern that matches the received power pattern of "medium, medium, medium, and high" to determine that the rail state is "Rail 5 crack".

In this manner, a received power pattern specific to each rail state is obtained, and hence the received power pattern for each rail state is stored in the determination table of FIG. 11. The analyzing unit 501 searches the determination table of FIG. 11 for a matched received power pattern, to thereby determine the current rail state and generate rail state information. The analyzing unit 501 transmits the rail state information to the information transmitting unit 601. The information transmitting unit 601 transmits the rail state information received from the analyzing unit 501 to the ground apparatus located in the outside. The ground apparatus is located on the ground in the outside of the vehicle 2.

Figure 12:
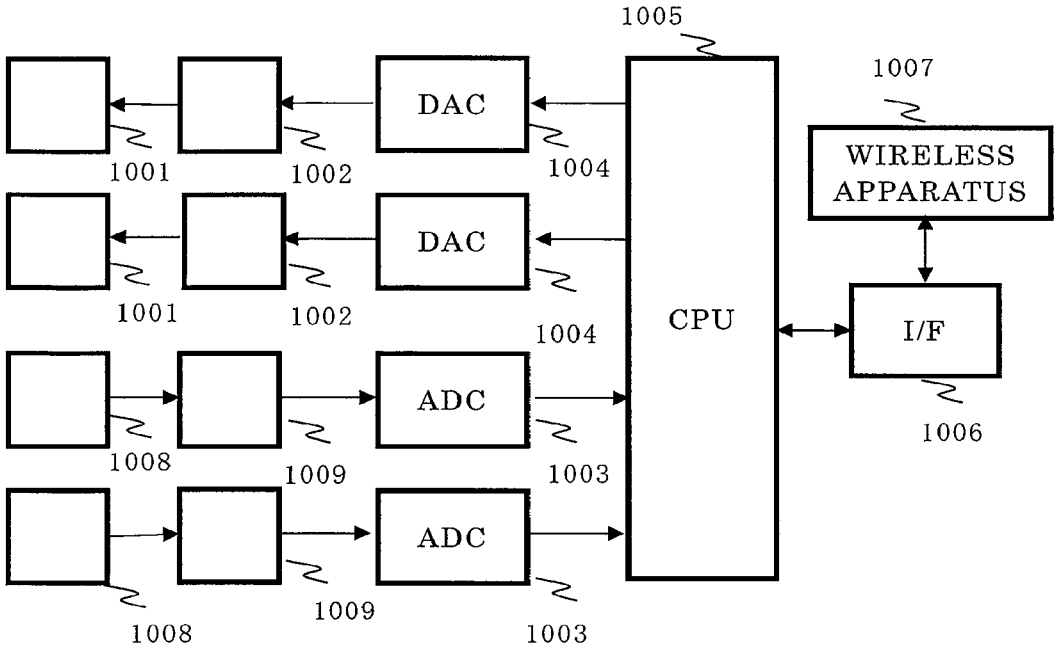
FIG. 12 is a diagram for illustrating a hardware configuration of the rail state monitoring apparatus according to the first embodiment of the present invention.

Each of the above-mentioned functions of the rail state monitoring apparatus according to the first embodiment is implemented by a processing circuit. The processing circuit configured to implement each of the functions may be specific hardware, or may be a processor configured to execute a program stored in a memory. FIG. 12 is a configuration diagram for illustrating a case in which each of the functions of the rail state monitoring apparatus 1 according to the first embodiment is implemented by a processing circuit including a processor and a memory.

As illustrated in FIG. 12, the rail state monitoring apparatus 1 includes an antenna 1001, 1008, an analog circuit 1002, 1009, an analog-to-digital converter (ADC) 1003, a digital-to-analog converter (DAC) 1004, a central processing unit (CPU) 1005, an interface (I/F) 1006, and a wireless apparatus 1007.

The CPU 1005 generates an electric signal, and outputs the electric signal to the analog circuit 1002 via the DAC 1004. The analog circuit 1002 amplifies the electric signal, and outputs the electric signal to the antenna 1001. The antenna 1001 transmits the electric signal. Meanwhile, the electric signal received by the antenna 1008 is output to the analog circuit 1009. The analog circuit 1009 amplifies the electric signal while eliminating noise, and transmits the electric signal to the CPU 1005 via the ADC 1003. The CPU 1005 measures the received power of the electric signal and determines the rail state. The CPU 1005 outputs a result of the determination to the wireless apparatus 1007 via the I/F 1006. The wireless apparatus 1007 transmits the result of the determination to an external apparatus or a neighboring vehicle.

In this manner, the first transmission antenna 101 and the second transmission antenna 102 are each formed of the antenna 1001. Similarly, the first reception antenna 201 and the second reception antenna 202 are each formed of the antenna 1008. When the processing circuit is a processor, the functions of respective components, namely, the transmitting unit 301, the receiving unit 401, the analyzing unit 501, and the information transmitting unit 601 are implemented by software, firmware, or a combination of software and firmware. The software and the firmware are described as programs, and are stored in the memory. The processor implements the functions of the respective components by reading the programs stored in the memory and executing the programs. That is, the rail state monitoring apparatus 1 includes a memory for storing programs to be executed by the processing circuit so that a transmission step, a reception step, an analysis step, and an information transmission step are executed as a result.

It is to be understood that those programs cause a computer to execute a procedure or a method for the respective components described above. In this case, the memory corresponds to, for example, a random access memory (RAM), a read only memory (ROM), a flash memory, an erasable programmable read only memory (EPROM), an electrically erasable and programmable read only memory (EEPROM), or other such nonvolatile or volatile semiconductor memory. The memory also corresponds to a magnetic disk, a flexible disk, an optical disc, a Compact Disc, a MiniDisc, a DVD, or other such medium.

The functions of the respective components described above may be partially implemented by specific hardware and partially implemented by software or firmware.

In this manner, the processing circuit can implement the functions of the respective components described above by hardware, software, firmware, or a combination thereof.

Figure 13:
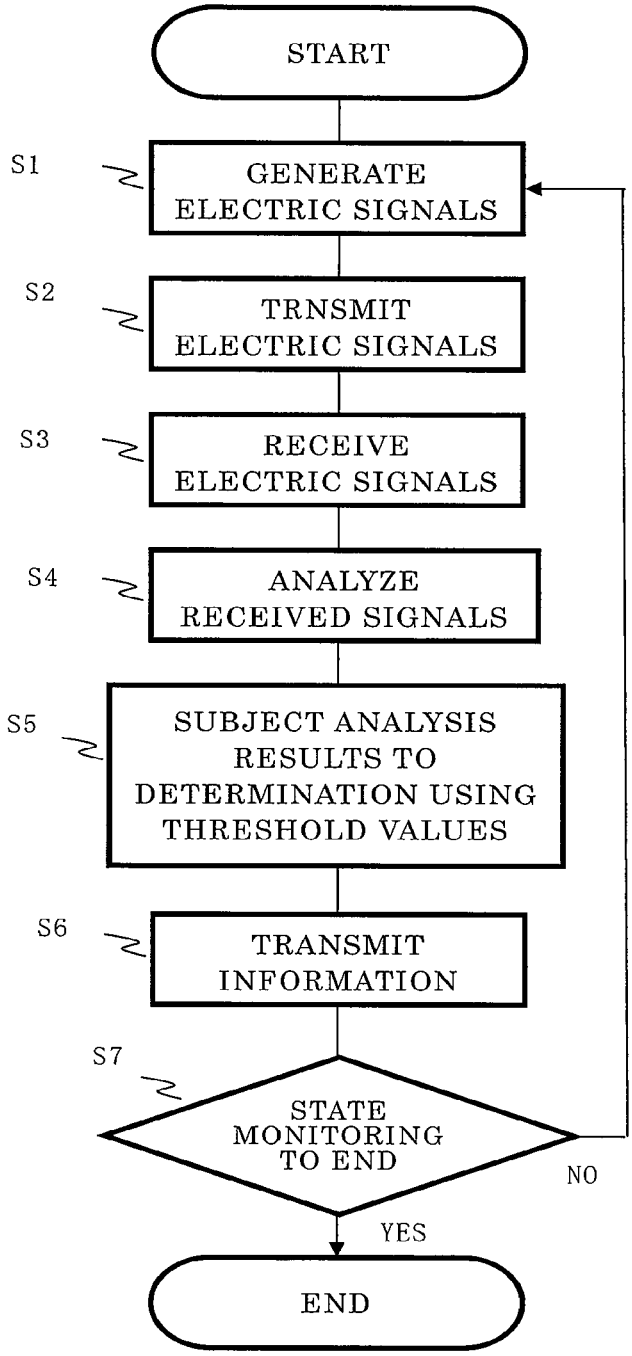
FIG. 13 is a flowchart for illustrating a flow of processing performed by the rail state monitoring apparatus according to the first embodiment of the present invention.

FIG. 13 is a flowchart for illustrating a flow of processing of the rail state monitoring apparatus 1 according to the first embodiment. The processing of FIG. 13 is repeatedly executed at a cycle period set in advance.

In FIG. 13, first, in Step S1, the transmitting unit 301 generates a first electric signal, and outputs the first electric signal to the first transmission antenna 101. In addition, the transmitting unit 301 generates a second electric signal, and outputs the second electric signal to the second transmission antenna 102.

In Step S2, the first transmission antenna 101 outputs the first electric signal to the rail 5. Meanwhile, the second transmission antenna 102 outputs the second electric signal to the rail 6.

In Step S3, the first reception antenna 201 and the second reception antenna 202 receive the first electric signal and the second electric signal.

In Step S4, the receiving unit 401 calculates the received powers of the first electric signal and the second electric signal, which are received by the first reception antenna 201 and the second reception antenna 202, and outputs the received powers to the analyzing unit 501.

In Step S5, the analyzing unit 501 subjects the received powers calculated by the receiving unit 401 to the determination using the threshold values, classifies the received powers into the three levels of "high", "medium", and "low", and generates a received power pattern. The analyzing unit 501 searches the determination table shown in FIG. 11 for a received power pattern that matches the generated received power pattern to determine the rail states of the rail 5 and the rail 6, and outputs the rail states as the rail state information.

In Step S6, the information transmitting unit 601 transmits the rail state information output from the analyzing unit 501 to the ground apparatus disposed in the outside.

In Step S7, the analyzing unit 501 determines whether rail state monitoring processing for the rail 5 and the rail 6 has been finished. When the rail state monitoring processing has not been finished, the processing returns to Step S1, and when the rail state monitoring processing has been finished, the processing of the rail state monitoring apparatus 1 according to the first embodiment is brought to an end.

As described above, according to the first embodiment, the analyzing unit 501 analyzes two kinds of propagation waves, namely, a surface wave and a guided wave, to thereby be able to determine the rail state as at least one of four states, namely, "normal", "broken", "crack", and "surface anomaly".

As described above, in the related-art apparatus disclosed in Japanese Patent Application Laid-open No. 2002-294609, an electric signal is not propagated even when a contact failure occurs between the rail and the wheel, which leads to a problem that a rail breakage and a contact failure cannot be distinguished from each other, to thereby cause erroneous determination. In view of this, another related-art apparatus is configured to compare detection results obtained by respective rail state monitoring apparatus, which are mounted to different vehicles, in order to reduce a rate of erroneous detection due to the erroneous determination. However, even with this configuration, when there is a change of the state, for example, when the rail is broken after the passage of one of the vehicles, the detection results do not match each other between the vehicles, and hence accurate determination becomes difficult.

In contrast, with the rail state monitoring apparatus according to the first embodiment, it is possible to detect a rail breakage and a rail surface anomaly in distinction from each other. Therefore, it is possible to inhibit presence of a rail breakage from being erroneously determined. The rail state monitoring apparatus according to the first embodiment can also perform the determination with a higher degree of reliability through use of one apparatus configuration.

In the first embodiment, it is also possible to store the rail state information obtained by the analyzing unit 501 in the memory at each spot to detect changes over time of the rail state information. That is, it is possible to detect the presence or absence of deterioration in rail state based on the presence or absence of reduction in received power. Further, the detection of a starting point at which the deterioration of the rail has started enables the rail state to be monitored with high accuracy.

In addition, the electric characteristics of the rail vary depending on weather conditions, but in the first embodiment, by statistically processing the changes over time, it is possible to monitor the rail state with a high degree of reliability without being affected by, for example, the weather conditions.

Furthermore, in the first embodiment, the rail state monitoring apparatus 1 is constructed as an on-vehicle apparatus mounted to the vehicle 2, and hence it is possible to suppress the cost of initial installation and maintenance management compared to a case in which the rail state monitoring apparatus 1 is constructed as a ground apparatus.

Second Embodiment

Figure 14:
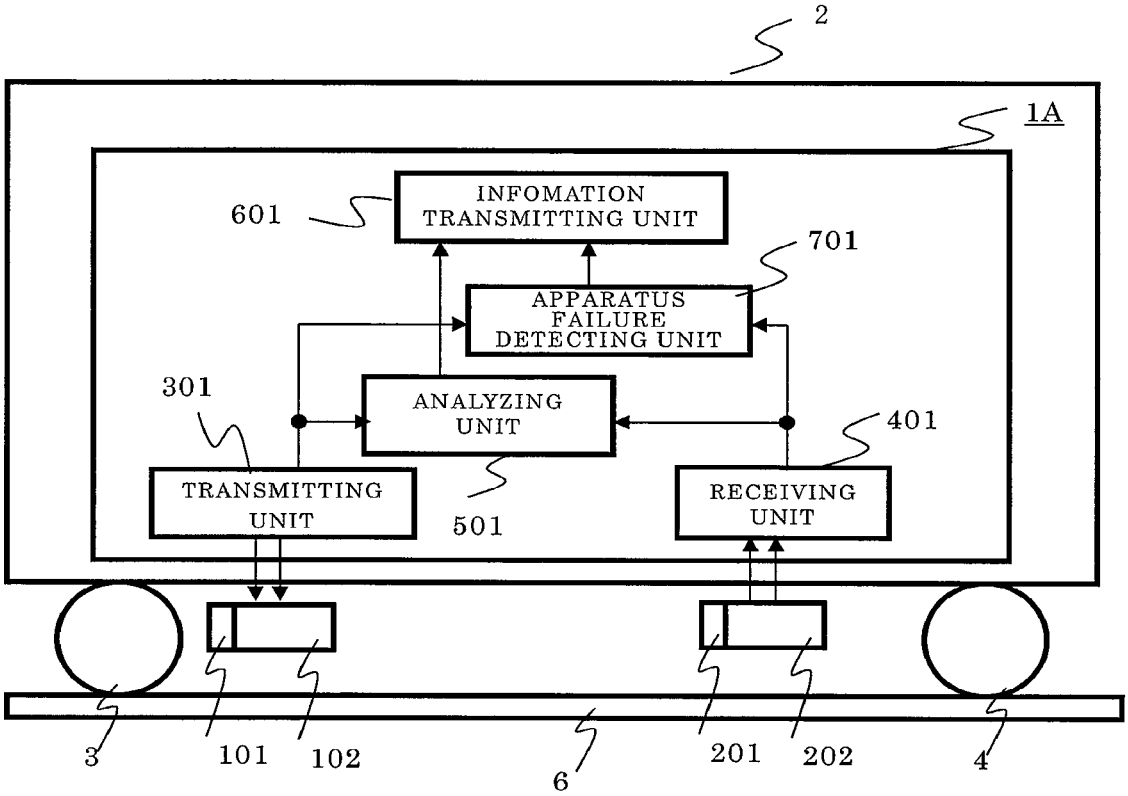
FIG. 14 is a configuration diagram for illustrating a configuration of a rail state monitoring apparatus according to a second embodiment of the present invention.

FIG. 14 is a diagram for schematically illustrating a configuration of a rail state monitoring apparatus 1A according to a second embodiment of the present invention. As illustrated in FIG. 14, in the rail state monitoring apparatus 1A according to the second embodiment, the apparatus failure detecting unit 701 is added to the components of the rail state monitoring apparatus 1 according to the first embodiment illustrated in FIG. 2. In the second embodiment, the apparatus failure detecting unit 701 is disposed, and hence it is possible to provide a rail state monitoring apparatus with higher reliability. The other components and operations are the same as those in the first embodiment.

The apparatus failure detecting unit 701 receives the input of the first electric signal and the second electric signal from the transmitting unit 301. The apparatus failure detecting unit 701 also receives the input of the received powers of the first electric signal and the second electric signal, which are received by the first reception antenna 201 and the second reception antenna 202, from the receiving unit 401. The apparatus failure detecting unit 701 subjects the received power of the first electric signal and the received power of the second electric signal to determination using threshold values. At this time, it suffices that the number of threshold values is one. In the following description, such one threshold value is referred to as "threshold value Th3". In the following description, the received power pattern generated by the apparatus failure detecting unit 701 is referred to as "second received power pattern". The second received power pattern includes the received powers of the first electric signal and the second electric signal, which are received by the first reception antenna 201, and the received powers of the first electric signal and the second electric signal, which are received by the second reception antenna 202.

When the received powers of the first electric signal received by the first reception antenna 201 and the second reception antenna 202 are both smaller than the threshold value Th3, the apparatus failure detecting unit 701 generates a second received power pattern of "low, high, low, and high", and determines that a failure has occurred in the first transmission antenna 101.

When the received powers of the second electric signal received by the first reception antenna 201 and the second reception antenna 202 are both smaller than the threshold value Th3, the apparatus failure detecting unit 701 generates a second received power pattern of "high, low, high, and low", and determines that a failure has occurred in the second transmission antenna 102.

When the received powers of the first electric signal and the second electric signal, which are received by the first reception antenna 201, are both smaller than the threshold value Th3, the apparatus failure detecting unit 701 generates a second received power pattern of "low, low, high, and high", and determines that a failure has occurred in the first reception antenna 201.

When the received powers of the second electric signal and the second electric signal, which are received by the second reception antenna 202, are both smaller than the threshold value Th3, the apparatus failure detecting unit 701 generates a second received power pattern of "high, high, low, and low", and determines that a failure has occurred in the second reception antenna 202.

In this manner, an anomaly in the apparatus can be detected by the apparatus failure detecting unit 701. Also in such a case, by combining the analysis result obtained by the apparatus failure detecting unit 701 and the analysis result obtained by the analyzing unit 501 with each other, it is possible to detect some kind of states of the rail 5 and the rail 6 even when a failure has occurred in the apparatus.

Figure 15:
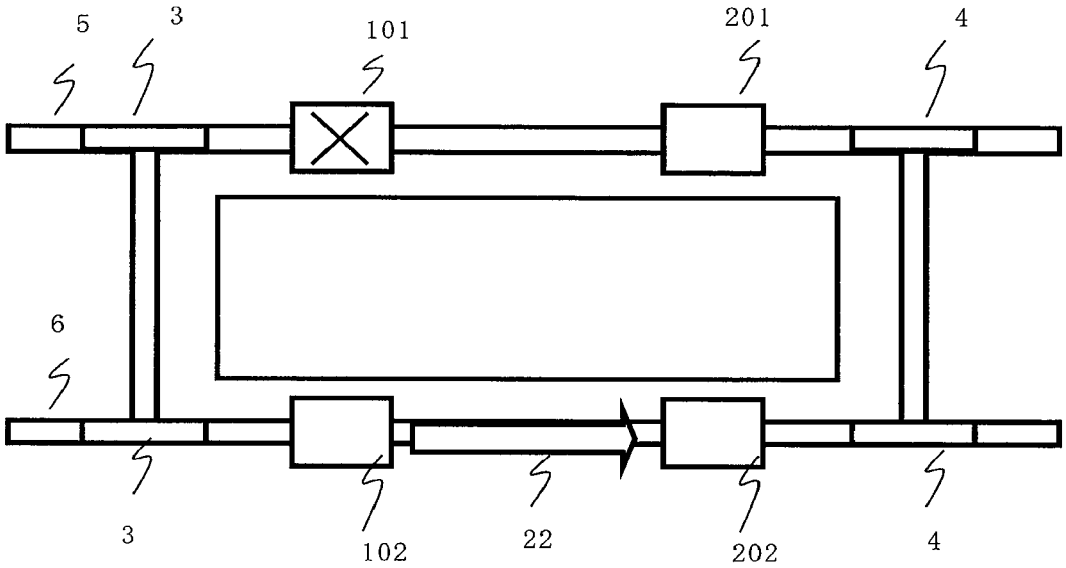
FIG. 15 is a diagram for illustrating a propagation path of an electric signal exhibited in the rail state monitoring apparatus according to the second embodiment of the present invention.

With reference to FIG. 15, a description is given for a case where a failure has occurred in the first transmission antenna 101.

When a failure has occurred in the first transmission antenna 101, the first electric signal is not transmitted. Therefore, the first reception antenna 201 receives the second electric signal propagated as the second guided wave 32, and outputs the second electric signal to the receiving unit 401. Meanwhile, the second reception antenna 202 receives the second electric signal propagated as the second surface wave 22 and the second guided wave 32, and outputs the second electric signal to the receiving unit 401.

With this processing, the apparatus failure detecting unit 701 determines that a failure has occurred in the first transmission antenna 101 based on the received power of the electric signal from the receiving unit 401.

A description is given for a case in which a rail breakage has occurred in addition to the failure in the first transmission antenna 101 at this time. In that case, the loop coil 10 is disconnected, and hence the guided wave 31 and the guided wave 32 are not propagated. This brings the first reception antenna 201 to a non-reception state. The second reception antenna 202 receives the second surface wave 22 when the rail 5 is broken, and is brought to a non-reception state when the rail 6 is broken.

Next, a description is given for a case in which a rail surface anomaly has occurred in the rail 5 in addition to the failure in the first transmission antenna 101. In that case, an electrical contact failure occurs between the wheels 3 and the rail 5 when the wheel 3 passes the anomaly spot on the rail 5. Therefore, the loop coil 10 is disconnected, and the guided wave 31 and the guided wave 32 are not propagated. This brings the first reception antenna 201 to a non-reception state. The second reception antenna 202 receives only the second surface wave 22.

In this manner, even when a failure has occurred in the first transmission antenna 101, the analyzing unit 501 can detect at least a rail breakage or a rail surface anomaly.

Therefore, when apparatus failure information for notifying that a failure has occurred in the first transmission antenna 101 is received from the apparatus failure detecting unit 701, the analyzing unit 501 uses only the received power of the second electric signal to determine the rail state. In the same manner, when apparatus failure information for notifying that a failure has occurred in the second transmission antenna 102 is received from the apparatus failure detecting unit 701, the analyzing unit 501 uses only the received power of the first electric signal to determine the rail state.

Figure 16:
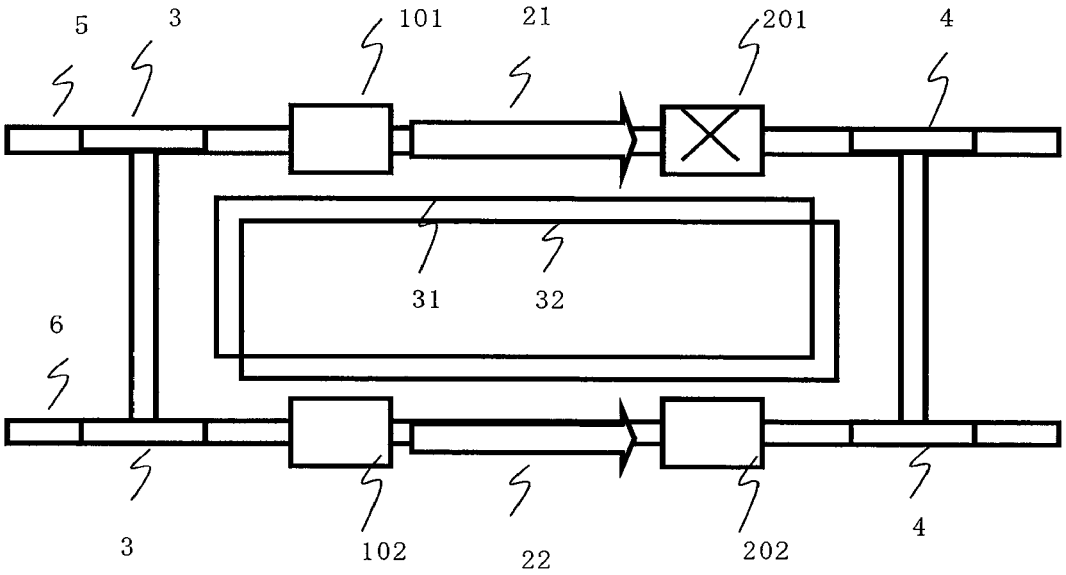
FIG. 16 is a diagram for illustrating a propagation path of an electric signal exhibited in the rail state monitoring apparatus according to the second embodiment of the present invention.

Next, with reference to FIG. 16, a description is given for an electric signal to be received by each of the first reception antenna 201 and the second reception antenna 202 when a failure has occurred in the first reception antenna 201.

Even when the first surface wave 21, the first guided wave 31, and the second guided wave 32 are propagated to the first reception antenna 201, the first reception antenna 201 fails to receive the first surface wave 21, the first guided wave 31, and the second guided wave 32 due to the failure, and outputs the non-reception state.

The second reception antenna 202 receives the first guided wave 31, the second surface wave 22, and the second guided wave 32, and outputs the first electric signal and the second electric signal.

With this processing, the apparatus failure detecting unit 701 determines that a failure has occurred in the first transmission antenna 201 based on the received power of the electric signal from the receiving unit 401.

A description is given for a case in which a rail breakage has occurred in addition to the failure in the first transmission antenna 201 at this time.

When the rail 5 is broken, the second reception antenna 202 receives the second surface wave 22. When the rail 6 is broken, the second reception antenna 202 is brought to a non-reception state.

A description is also given for a case in which a rail surface anomaly has occurred in addition to the failure in the first reception antenna 201.

When a rail surface anomaly has occurred, the guided wave 31 and the guided wave 32 are not propagated. Therefore, the second reception antenna 202 receives the second surface wave 22.

In this manner, even when a failure has occurred in the first reception antenna 201, the analyzing unit 501 can detect at least a rail breakage or a rail surface anomaly.

Therefore, when apparatus failure information notifying that a failure has occurred in the first reception antenna 201 is received from the apparatus failure detecting unit 701, the analyzing unit 501 uses only the received powers of the first electric signal and the second electric signal, which are received by the second reception antenna 202, to determine the rail state. In the same manner, when apparatus failure information notifying that a failure has occurred in the second reception antenna 202 is received from the apparatus failure detecting unit 701, the analyzing unit 501 uses only the received powers of the first electric signal and the second electric signal, which are received by the first reception antenna 201, to determine the rail state.

Figure 18:
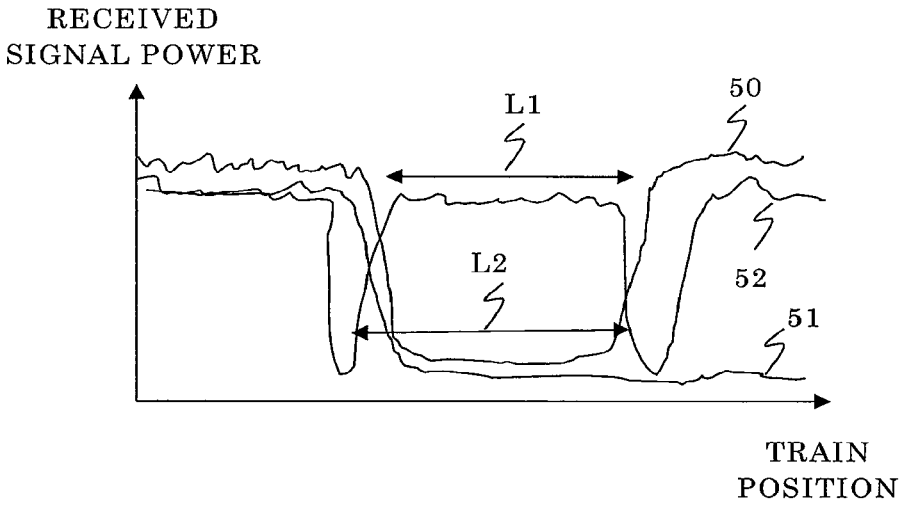
FIG. 18 is a graph for showing time-series data exhibited in the rail state monitoring apparatus according to the second embodiment of the present invention at a time of a failure in an antenna and a time of a rail breakage.

Next, with reference to FIG. 18, a description is given for a determination method of distinguishing among a case of an apparatus failure in which a failure has occurred in a transmission antenna or a reception antenna, a case in which a rail breakage has occurred, and a case in which a rail surface anomaly has occurred from one another. In FIG. 18, the horizontal axis represents a train position, and the vertical axis represents a received power. In FIG. 18, a solid line 50 is a graph of a received power exhibited in the case of a rail breakage, a solid line 51 is a graph of a received power exhibited in the case of an apparatus failure, and a solid line 52 is a graph of a received power exhibited in the case of a rail surface anomaly. A distance between the first transmission antenna 101 and the first reception antenna 201 is represented as L1, and a distance between the front wheel 3 and the rear wheel 4 is represented as L2.

In FIG. 18, as indicated by the solid line 50, a drop of the received power due to a rail breakage has a distance equal to or shorter than the distance L1. Meanwhile, as indicated by the solid line 51, a drop of the received power due to an apparatus failure has a distance longer than the distance L1. In the case of the rail surface anomaly, the signal drops in power when the wheel 3 or 4 is brought into contact with the anomaly spot, and hence, as indicated by the solid line 52, the drop of the signal power appears twice with an interval of the distance L2.

Therefore, in order to increase accuracy in determination, the analyzing unit 501 may obtain the running distance in which the received power drops based on data of the received power from the receiving unit 401, and may determine the rail state based on the received power pattern and the running distance. In that case, a determination table shown in FIG. 19 is used. In the determination table, the received power pattern and a condition for the running distance are stored for each rail state. The analyzing unit 501 generates a received power pattern based on the received power calculated by the receiving unit 401, and calculates the running distance in which the received power drops. Then, the analyzing unit 501 searches the determination table of FIG. 19 for a received power pattern that matches the generated received power pattern, and when there is a match, determines whether the calculated running distance satisfies the condition for the running distance in the determination table of FIG. 19. By thus determining the rail state through use of information on the running distance in which the received power drops and the received powers of the first electric signal and the second electric signal, it is possible to determine the states of the rail 5 and the rail 6 with higher accuracy.

Figure 20:
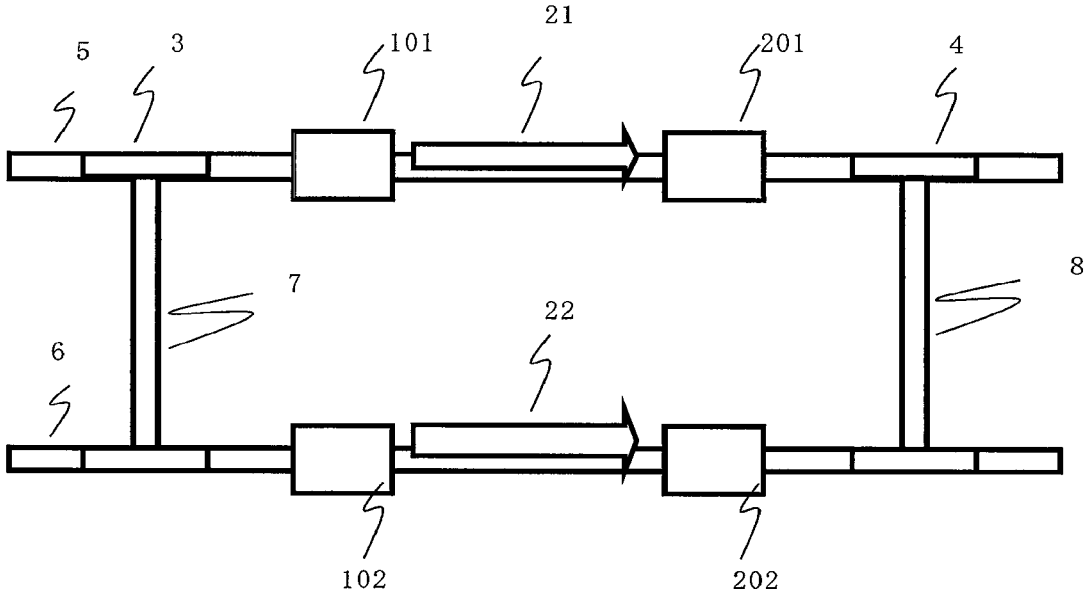
FIG. 20 is a diagram for illustrating a propagation path of an electric signal exhibited in the rail state monitoring apparatus according to the second embodiment of the present invention.

Next, with reference to FIG. 20, a description is given for an electric signal to be received by each of the first reception antenna 201 and the second reception antenna 202 when an anomaly occurs in the wheel 3 or the wheel 4.

When an anomaly occurs in the wheel 3 or the wheel 4, the loop coil 10 is disconnected or the impedance of the loop coil 10 is changed, and hence the propagation states of the guided waves 31 and 32 are changed. The first reception antenna 201 receives the first surface wave 21, and outputs the first electric signal to the receiving unit 401. The second reception antenna 202 receives the second surface wave 22, and outputs the second electric signal to the receiving unit 401. Therefore, the received power pattern generated by the analyzing unit 501 becomes "high, low, low, and high". This received power pattern is the same as in the case in which a surface anomaly has occurred in the rail 5 and the rail 6. In view of this, a determination method of distinguishing between a case in which an anomaly has occurred in the wheel 3 or the wheel 4 and a case in which a rail surface anomaly has occurred is described below.

First, a description is given for a difference between the case in which an anomaly has occurred in the wheel 3 or the wheel 4 and the case in which a rail surface anomaly has occurred. In the case in which a rail surface anomaly has occurred, the loop coil 10 is disconnected only at a moment when the wheel passes the anomaly spot. The anomaly spot is passed by the front wheel 3 and the rear wheel 4 successively, and hence the loop coil 10 is disconnected twice with a time interval calculated based on the velocity of the train and the distance between the front and rear wheels. Therefore, the drop of the received power appears twice with the interval of the distance L2. Meanwhile, when an anomaly occurs in the wheel 3 or the wheel 4, the loop coil 10 is disconnected at all times, and hence the running distance in which the received power drops becomes longer than the distance L1. Therefore, the analyzing unit 501 searches the determination table of FIG. 19 for a received power pattern that matches the generated received power pattern, and when there is a match, determines whether the calculated running distance satisfies the condition for the running distance in the determination table of FIG. 19. This allows the analyzing unit 501 to correctly determine the case in which an anomaly has occurred in the wheel 3 or the wheel 4 and the case in which a rail surface anomaly has occurred in distinction from each other.

In consideration of the above description, because the analyzing unit 501 and the apparatus failure detecting unit 701 are configured to perform the determination through use of the information on the running distance in which the received power drops and on the received powers of the first electric signal and the second electric signal based on the determination table shown in FIG. 19, it is possible to determine the states of the rail 5, the rail 6, and the apparatus with higher accuracy. In the determination table of FIG. 19, all the received power patterns are different from one another without an overlap between any pair of conditions, and hence it is possible to identify the rail state as at least one state.

As described above, according to the second embodiment, in the same manner as in the first embodiment, the analyzing unit 501 analyzes two kinds of propagation waves, namely, the surface waves 21 and 22 and the guided waves 31 and 32, to thereby be able to determine the rail state as one of "good", "rail broken", "rail crack", and "rail surface anomaly". In addition, in the second embodiment, the apparatus failure detecting unit 701 is included, and hence it is possible to simultaneously determine a failure in the rail state monitoring apparatus 1A.

Therefore, according to the second embodiment, an apparatus failure in the rail state monitoring apparatus 1A and an anomaly in the rail state can be determined in distinction from each other. In this manner, according to the second embodiment, a failure in the rail state monitoring apparatus 1A can be detected, and hence it is possible to achieve a fail-safe system.

Third Embodiment

The third embodiment of the present invention is described by taking a case in which the rail state monitoring apparatus 1 cooperates with a ground apparatus 40. In this case, the description is given by taking a method for safe train operation management performed when an anomalous state has occurred in the rail.

Figure 21:
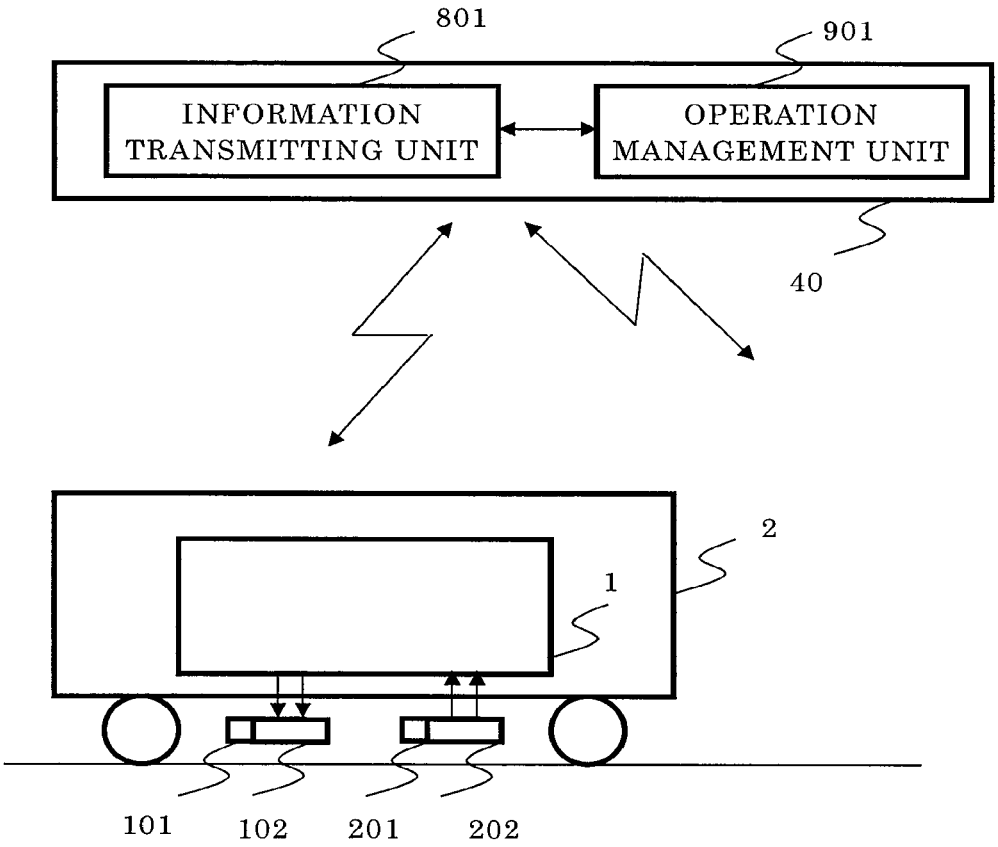
FIG. 21 is a configuration diagram for illustrating a configuration of a rail state monitoring apparatus according to a third embodiment of the present invention.

As illustrated in FIG. 21, the ground apparatus 40 includes an information transmitting unit 801 and an operation management unit 901. A configuration of the rail state monitoring apparatus 1 is the same as that of the rail state monitoring apparatus 1 described in the first embodiment, and hence a description thereof is omitted below.

In the rail state monitoring apparatus 1, the information transmitting unit 601 transmits the rail state information received from the analyzing unit 501 to the ground apparatus 40. The rail state information includes a vehicle position of the vehicle 2, the rail state determined by the analyzing unit 501, and the received powers of the first electric signal and the second electric signal, which are received by each of the first reception antenna 201 and the second reception antenna 202.

As a method of acquiring the vehicle position of the vehicle 2, for example, a vehicle position measured based on a map and satellite positioning may be acquired, or a mileage position of the train managed by an already-existing train control apparatus may be acquired. In this case, the train control apparatus refers to an apparatus configured to control the operations of all trains.

When receiving the rail state information from the rail state monitoring apparatus 1, the information transmitting unit 801 of the ground apparatus 40 outputs the rail state information to the operation management unit 901.

The operation management unit 901 reads the rail state information input from the information transmitting unit 801. As a result, when the rail state information includes information on "rail broken", "rail crack", or other such anomaly, the operation management unit 901 transmits the information on the anomaly to another train via the information transmitting unit 801. In addition, the operation management unit 901 generates an instruction signal for causing other trains to stop traveling or to slow down as required, and transmits the instruction signal to other trains via the information transmitting unit 801.

The third embodiment is effective particularly in a moving block system. That is, when a rail is broken, an operation to which the concept of a fixed block system is virtually applied is performed, to thereby be able to improve safety. The moving block system refers to a block system for controlling a train interval in consideration of a distance from a preceding vehicle and the speeds of both trains. In contrast, the fixed block system refers to a block system in which a block section is fixed. In the fixed block system, the block section is set in a section between adjacent stations or a section between adjacent signals.

Figure 22:
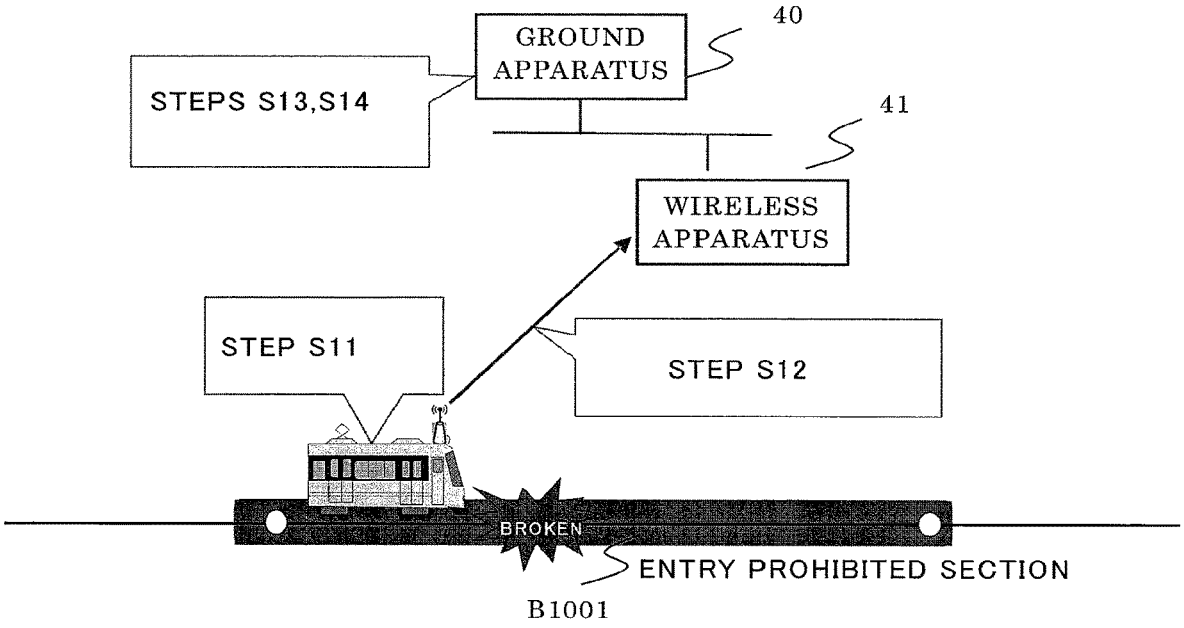
FIG. 22 is a diagram for illustrating a flow of the rail state monitoring apparatus according to the third embodiment of the present invention.
Figure 23:
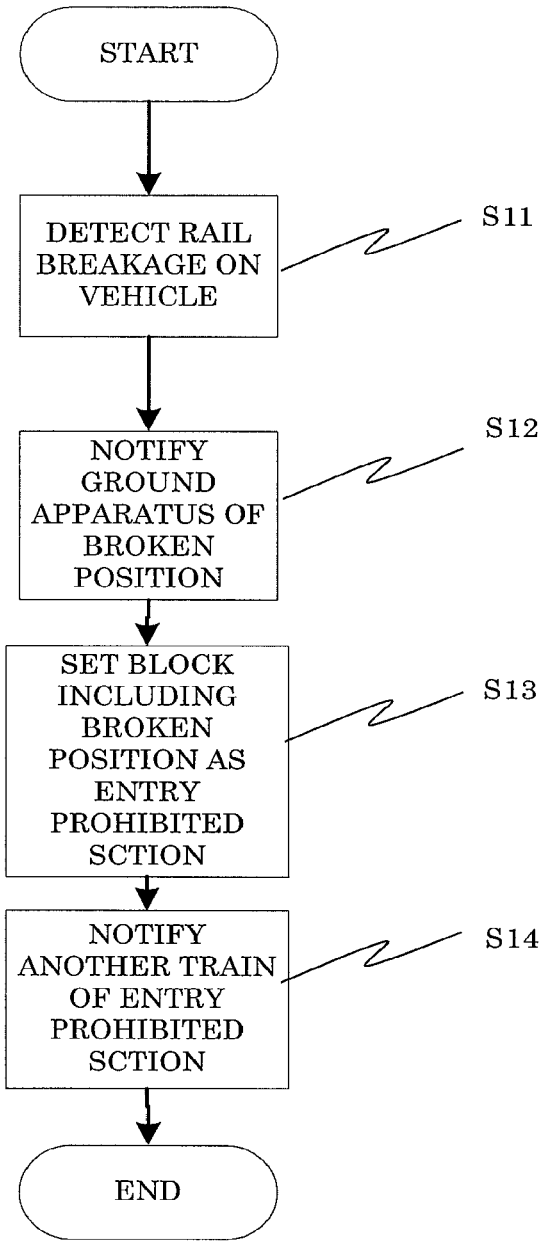
FIG. 23 is a flowchart for illustrating a flow of processing performed by the rail state monitoring apparatus according to the third embodiment of the present invention.
Figure 24:
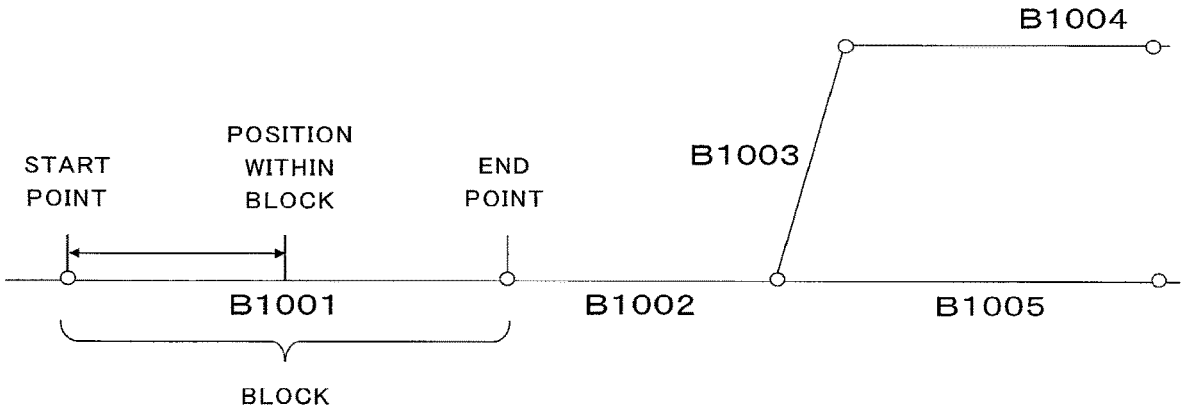
FIG. 24 is a diagram for illustrating a block defined by segmenting a railway track in the third embodiment of the present invention.

FIG. 22 to FIG. 24 are a specific example of a case in which the rail state monitoring apparatus 1 has detected a rail breakage at a middle point between a station and the next station. As illustrated in FIG. 24, the rail is divided into a plurality of sections to form a plurality of blocks. In the example of FIG. 24, five blocks, namely, blocks B1001, B1002, B1003, B1004, and B1005 are formed. A train control apparatus (not shown) and the ground apparatus 40 each hold block information on those blocks in the memory. The train control apparatus refers to an apparatus configured to control the operations of all trains.

As illustrated in FIG. 22 and FIG. 23, first, in Step S11, the rail state monitoring apparatus 1 mounted to the vehicle 2 detects a rail breakage.

Subsequently, in Step S12, the rail state monitoring apparatus 1 notifies the ground apparatus 40 of information on a rail broken position as the rail state information.

Subsequently, in Step S13, the ground apparatus 40 receives the information on the rail broken position via a wireless apparatus 41. The ground apparatus 40 identifies the block including the rail broken position, and sets the block as an entry prohibited section.

Subsequently, in Step S14, the ground apparatus 40 transmits information on the block set as the entry prohibited section to all the trains via the wireless apparatus 41 to inhibit each train to pass through the block set as the entry prohibited section.

Figure 25:
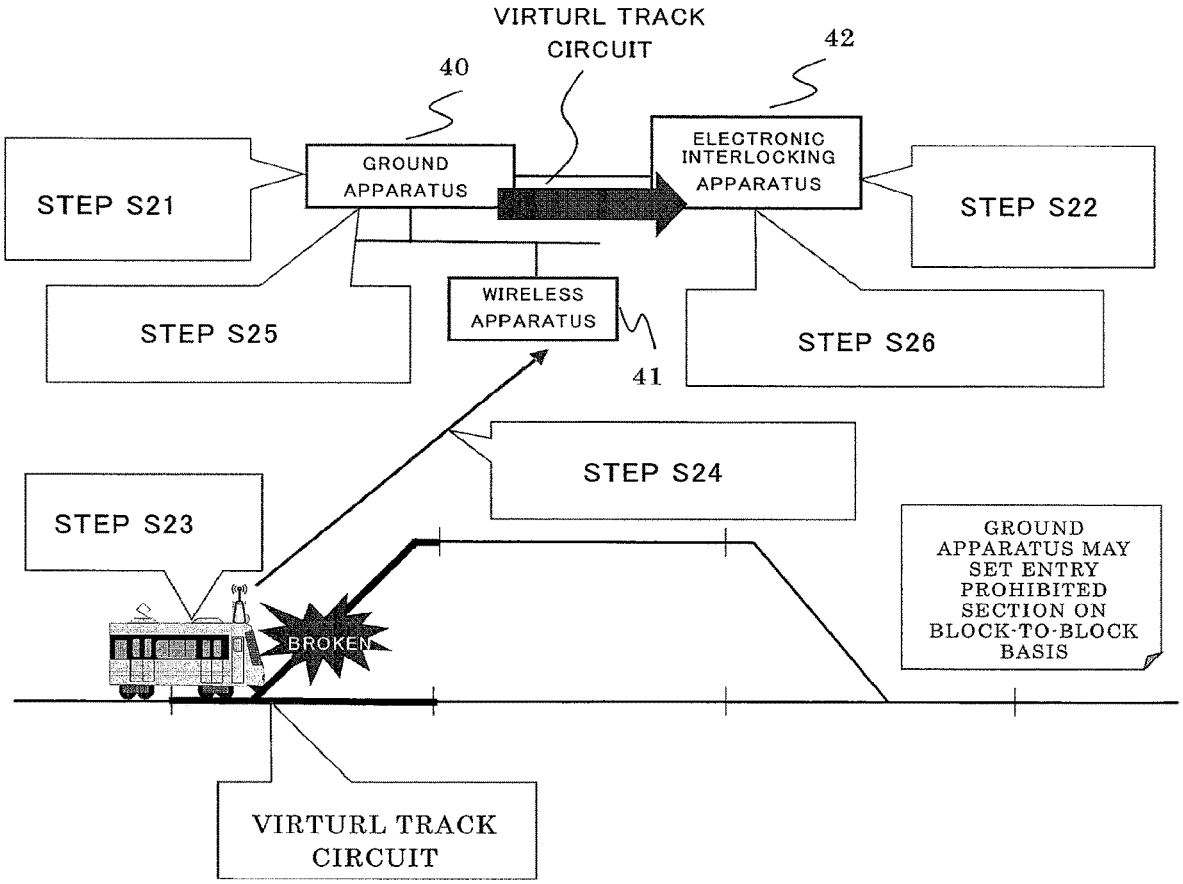
FIG. 25 is a diagram for illustrating a flow of the rail state monitoring apparatus according to the third embodiment of the present invention.
Figure 26:
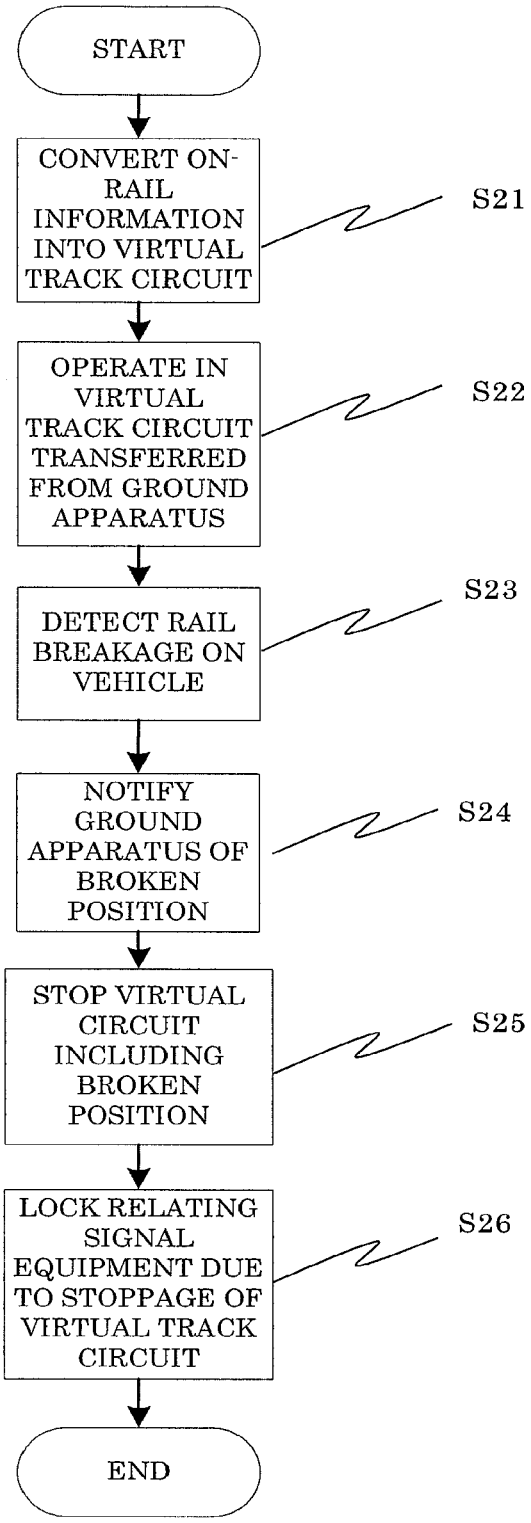
FIG. 26 is a flowchart for illustrating a flow of processing performed by the rail state monitoring apparatus according to the third embodiment of the present invention.
Figure 27:
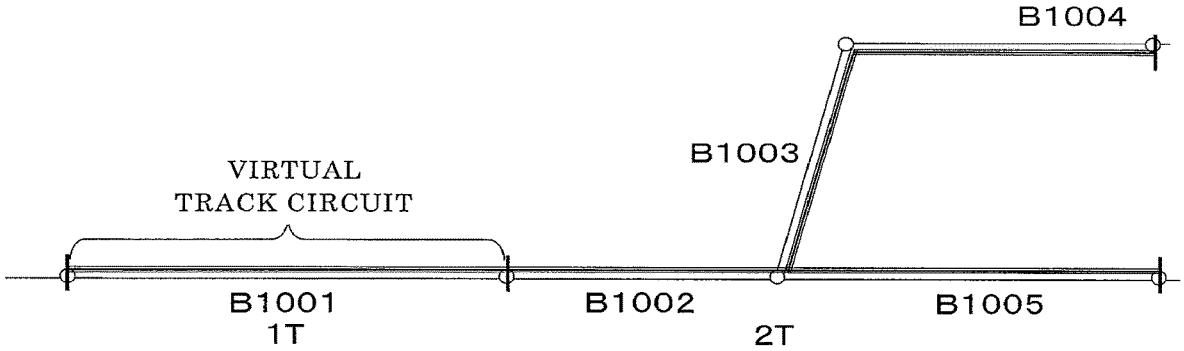
FIG. 27 is a diagram for illustrating a block defined by segmenting a railway track in the third embodiment of the present invention.

FIG. 25 to FIG. 27 are a specific example of a case in which a rail breakage has been detected in station premises. As described above with reference to FIG. 24, the rail is divided into a plurality of sections to form a plurality of blocks. In the example of FIG. 24, five blocks, namely, the blocks B1001, B1002, B1003, B1004, and B1005 are formed. The train control apparatus and the ground apparatus 40 each hold the block information and virtual track information in the memory.

At this time, first, in Step S21, as illustrated in FIG. 27, virtual track circuits are assigned to the blocks B1001, B1002, B1003, B1004, and B1005, and on-rail information is converted into the virtual track circuit. The virtual track circuit serves as a track circuit utilized in related-art train operation management. As a method of assigning the virtual track circuit, one virtual track circuit may be assigned to one block, or one virtual track circuit may be assigned to a plurality of blocks.

Subsequently, in Step S22, the ground apparatus 40 transfers information on the virtual track circuit to an electronic interlocking apparatus 42. With this as a trigger, the electronic interlocking apparatus 42 starts an operation in the virtual track circuit. The electronic interlocking apparatus 42 is an apparatus configured to drive and control signal equipment.

Subsequently, in Step S23, the rail state monitoring apparatus 1 mounted to the vehicle 2 detects a rail breakage.

Subsequently, in Step S24, the rail state monitoring apparatus 1 notifies the ground apparatus 40 of information on a rail broken position as the rail state information.

Subsequently, in Step S25, the ground apparatus 40 receives the information on the rail broken position via the wireless apparatus 41. The ground apparatus 40 identifies the block including the rail broken position, and stops the virtual track circuit corresponding to the block.

Subsequently, in Step S26, the electronic interlocking apparatus 42 locks the signal equipment relating to the virtual track circuit due to the stoppage of the virtual track circuit.

As described above, according to the third embodiment, the rail state monitoring apparatus 1 is configured to cooperate with the ground apparatus 40, and hence it is possible to maintain safe train operations by sharing information among trains traveling along the same service line.

The above description of the third embodiment is given by taking the case where the rail state monitoring apparatus 1 according to the first embodiment and the ground apparatus 40 cooperate with each other, but the rail state monitoring apparatus 1A according to the second embodiment and the ground apparatus 40 may cooperate with each other. Also in that case, the same effects can be produced.

The above description is given by taking the case where the rail state monitoring apparatus 1 according to the first embodiment cooperates with the ground apparatus 40, but the present invention is not limited thereto, and the rail state monitoring apparatus 1A according to the second embodiment may cooperate with the ground apparatus 40.

Fourth Embodiment

Figure 28:
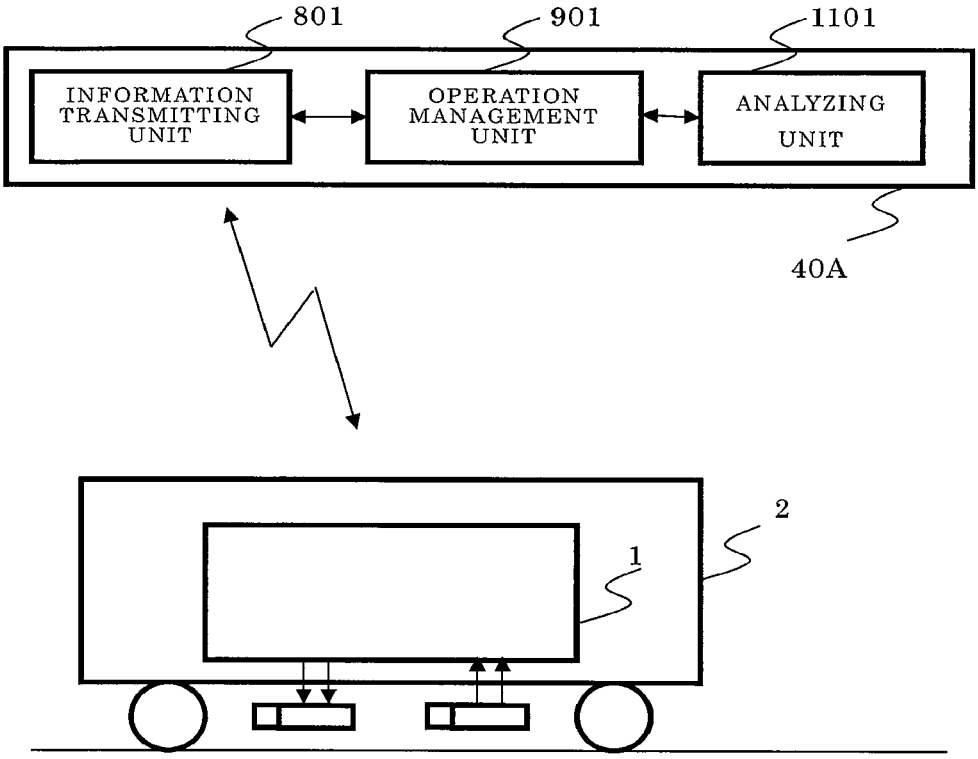
FIG. 28 is a configuration diagram for illustrating a configuration of a rail state monitoring apparatus according to a fourth embodiment of the present invention.

FIG. 28 is a diagram for illustrating a rail state monitoring apparatus 1 and a ground apparatus 40A in a fourth embodiment of the present invention.

In the fourth embodiment, in the same manner as in the third embodiment, a description is given for a case in which the rail state monitoring apparatus 1 cooperates with the ground apparatus 40A. A configuration of the rail state monitoring apparatus 1 according to the fourth embodiment is the same as that of the rail state monitoring apparatus 1 described in the first embodiment, and hence a description thereof is omitted below.

As illustrated in FIG. 28, the ground apparatus 40A includes the information transmitting unit 801, the operation management unit 901, and an analyzing unit 1101. The operations of the information transmitting unit 801 and the operation management unit 901 are basically the same as those of the third embodiment. The following description is given for the operation of the ground apparatus 40A mainly in terms of differences from that of the ground apparatus 40 according to the third embodiment.

The analyzing unit 1101 accumulates the rail state information received from the rail state monitoring apparatus 1 mounted to each vehicle 2 and the monitoring position calculated from the train position of the vehicle 2 in the memory together. The analyzing unit 1101 statistically processes a plurality of pieces of rail state information, and collectively manages the rail state of the entire rail. This allows the rail state to be monitored with a higher degree of reliability.

Now, a description is given for an operation of the rail state monitoring apparatus 1 according to the fourth embodiment.

The information transmitting unit 601 of the rail state monitoring apparatus 1 transmits the rail state information including the train position, the rail state, and the received powers and phases of the first electric signal and the second electric signal, which are received by the first reception antenna and the second reception antenna, to the ground apparatus 40A.

The information transmitting unit 601 of the ground apparatus 40A outputs the rail state information to the operation management unit 901 and the analyzing unit 1101.

The analyzing unit 1101 stores the received powers and the phases of the surface waves 21 and 22 and the received powers and the phases of the guided waves 31 and 32 for each train position, and analyzes time-series data on the received powers and the phases of the surface waves 21 and 22 and time-series data on the received powers and the phases of the guided waves 31 and 32 at each train position.

Figure 29:
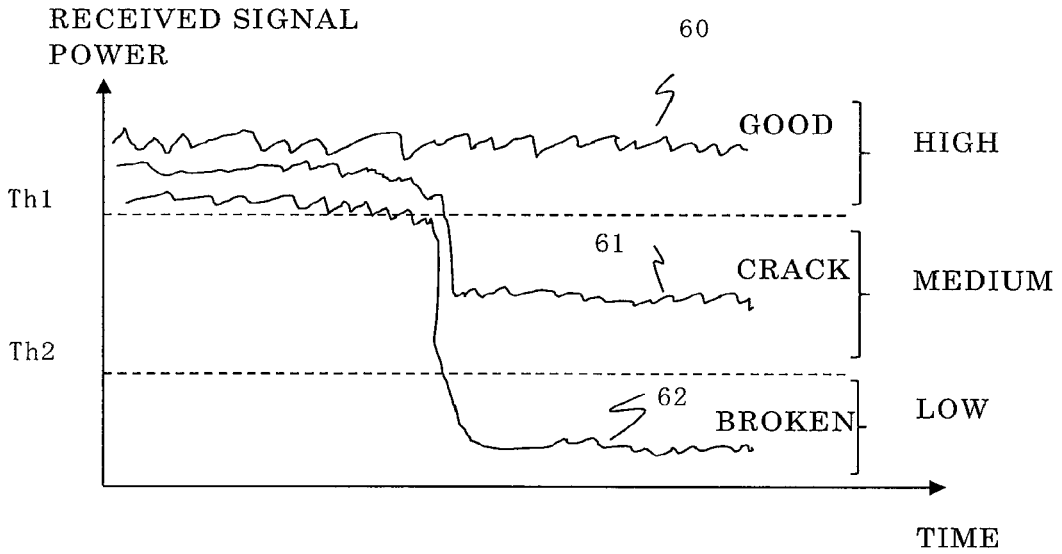
FIG. 29 is a graph for showing time-series data exhibited in the rail state monitoring apparatus according to the fourth embodiment of the present invention at a time of a good state, at the time of a rail crack, and at the time of a rail breakage.

FIG. 29 is a graph for showing the time-series data on the received power of a surface wave or a guided wave at a given spot. In FIG. 29, the horizontal axis represents a time, and the vertical axis represents a received signal power.

When a crack has occurred in the rail 5 or 6, the propagation state of the surface wave 21 or 22 is changed, for example, the surface wave 21 or 22 is reradiated at a crack spot. Therefore, the received power of the surface wave 21 or 22 drops due to the occurrence of a crack. The analyzing unit 1101 monitors the received power of the surface wave 21 or 22 at the same spot, and subjects the received power to the determination using the threshold values Th1 and Th2, to thereby detect a cracked state.

In addition, when a crack has occurred in the rail 5 or 6, the impedance of the loop coil 10 is changed, and hence the received power and the phase of the guided wave 31 or 32 is changed. Therefore, as shown in FIG. 29, the time-series data on the received power is monitored, and changes of the received power and the phase of the guided wave due to a crack are detected, to thereby detect a cracked state. Not only a crack but also a rail surface anomaly including corrosion due to rust which causes an increase in rail resistance value can be detected in the same manner.

The analyzing unit 1101 outputs the determination result as to whether the rail state is "good" or "crack" to the operation management unit 901 as second rail state information.

When the second rail state information includes information indicating that the rail state is "crack", the operation management unit 901 outputs rail crack information and instruction information for instructing a train to slow down to the information transmitting unit 801.

The information transmitting unit 801 transmits the instruction information to another train.

As described above, according to the fourth embodiment, the analyzing unit 1101 of the ground apparatus 40A analyzes variations with time of the propagation states of the surface waves 21 and 22 and the guided waves 31 and 32 at each spot, to thereby be able to detect the crack state exhibited before the rail is broken. In this manner, according to the fourth embodiment, a crack spot can be detected before a rail is broken, and hence it is possible to maintain safer train operations.

The above description is given by taking the case where the rail state monitoring apparatus 1 according to the first embodiment cooperates with the ground apparatus 40A, but the present invention is not limited thereto, and the rail state monitoring apparatus 1A according to the second embodiment may cooperate with the ground apparatus 40A.

Fifth Embodiment

In a fifth embodiment of the present invention, a description is given for another mode of the transmission antenna and the reception antenna.

Figure 30:
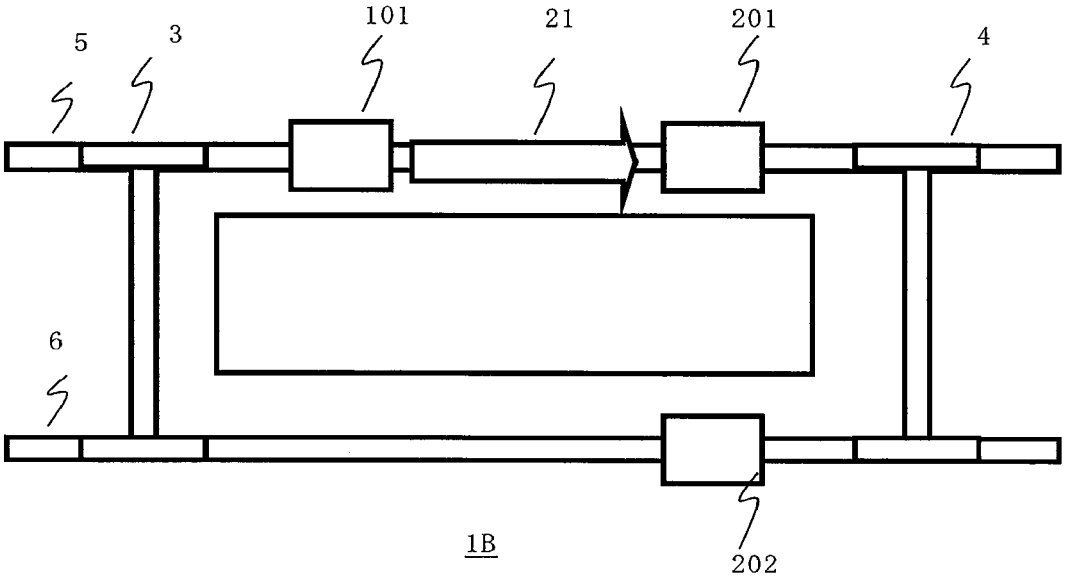
FIG. 30 is a diagram for illustrating a propagation path of an electric signal exhibited in a rail state monitoring apparatus according to a fifth embodiment of the present invention.

In the fifth embodiment, as illustrated in FIG. 30, the second transmission antenna 102 illustrated in FIG. 1 is removed. Therefore, as illustrated in FIG. 30, a rail state monitoring apparatus 1B according to the fifth embodiment includes the first transmission antenna 101, the first reception antenna 201, and the second reception antenna 202. Although not shown in FIG. 30, the rail state monitoring apparatus 1B also includes the transmitting unit 301, the receiving unit 401, the analyzing unit 501, and the information transmitting unit 601, which are illustrated in FIG. 1.

The first reception antenna 201 receives the first electric signal propagated as the first surface wave 21 and the first guided wave 31, and transmits the first electric signal to the receiving unit 401.

The second reception antenna 202 receives the first electric signal propagated as the first surface wave 31, and transmits the first electric signal to the receiving unit 401.

The receiving unit 401 calculates the received powers of the first electric signal, which are received by the first reception antenna 201 and the second reception antenna 202.

The analyzing unit 501 uses a determination table shown in FIG. 31 based on the received power calculated by the receiving unit 401 to determine the rail states of the rail 5 and the rail 6.

The rail state monitoring apparatus 1B may include the apparatus failure detecting unit 701 described in the second embodiment. In that case, the apparatus failure detecting unit 701 uses the determination table shown in FIG. 31 based on the received power calculated by the receiving unit 401 to determine the presence or absence of a failure in the first transmission antenna 101, the first reception antenna 201, the second reception antenna 202, and the wheels 3 and 4.

In this manner, even with the configuration illustrated in FIG. 30, it is possible to determine the states of the rails 5 and 6 from among "good", "rail broken", "rail surface anomaly", and "rail crack".

The above description is given by taking the case where the number of transmission antennas is one, but the number of reception antennas may be one instead. That is, the rail state monitoring apparatus 1B includes the first transmission antenna 101, the second transmission antenna 102, and the first reception antenna 201.

In that case, the first reception antenna 201 receives the first electric signal propagated as the first surface wave 21 and the first guided wave 31, and transmits the first electric signal to the receiving unit 401. Meanwhile, the first reception antenna 201 receives the second electric signal propagated as the second surface wave 22 and the second guided wave 32, and transmits the second electric signal to the receiving unit 401.

The receiving unit 401 calculates the received powers of the first electric signal and the second electric signal, which are received by the first reception antenna 201.

The analyzing unit 501 uses a determination table shown in FIG. 31 or FIG. 33 based on the received power calculated by the receiving unit 401 to determine the rail states of the rail 5 and the rail 6.

The rail state monitoring apparatus 1B may include, also in this case, the apparatus failure detecting unit 701 described in the second embodiment. In that case, the apparatus failure detecting unit 701 uses the determination table shown in FIG. 31 or FIG. 33 based on the received power calculated by the receiving unit 401 to determine the presence or absence of a failure in the first transmission antenna 101, the second transmission antenna 102, the first reception antenna 201, and the wheels 3 and 4.

As described above, according to the fifth embodiment, even when the number of transmission antennas is one or the number of reception antennas is one, the analyzing unit 501 can determine the rail states of the rails 5 and 6 from among "good", "rail broken", "rail surface anomaly", and "rail crack" through use of the determination table shown in FIG. 31 or FIG. 33.

The present invention has been described with reference to the specific preferred embodiments, but it is to be understood that various other adaptations and changes can be made within the spirit and scope of the present invention. Therefore, it is an object of the appended claims to cover all such modifications and changes that fall within the true spirit and scope of the present invention.

What is claimed is:

1. A rail state monitoring apparatus, comprising:

a transmission antenna, which is disposed on a vehicle, and is configured to transmit at least one of a first electric signal, which is to be transmitted to a first rail of a pair of rails, and a second electric signal, which is to be transmitted to a second rail of the pair of rails;

a reception antenna, which is disposed on the vehicle, and is configured to receive:

at least one of the first electric signal propagated through the first rail and the second electric signal propagated through the second rail; and at least one of the first electric signal propagated through an annular transmission line formed so as to include the first rail and the second rail and the second electric signal propagated through the annular transmission line; and a processor, wherein the processor is configured to:

set a first threshold value and a second threshold value smaller than the first threshold value in advance;

calculate received powers of the first electric signal and the second electric signal, which are received by the reception antenna;

classify each of the received powers as one of three levels of "high", "medium", and "low" in comparison with the first threshold value and the second threshold value to generate a received power pattern; and determine each of rail states of the first rail and the second rail as at least any one of "good", "rail broken", "rail crack", or "rail surface anomaly" based on the generated received power pattern, and output a result of the determination as rail state information, wherein the processor is further configured to set a third threshold value in advance;

classify each of the received powers of the first electric signal and the second electric signal, which are received by the reception antenna, as one of two levels of "high" and "low" in comparison with the third threshold value to generate a second received power pattern; and determine whether an anomaly has occurred in the transmission antenna and the reception antenna based on the second received power pattern, and when an anomaly has occurred, output apparatus failure information for notifying that the anomaly has occurred.

2. The rail state monitoring apparatus according to claim 1, wherein the processor is further configured to:

store a determination table in which a received power pattern is stored for each of the rail state of "good", "rail broken", "rail crack", and "rail surface anomaly" in a memory in advance; and search the determination table for a received power pattern that matches the generated received power pattern, to thereby determine each of the rail states of the first rail and the second rail as at least any one of "good", "rail broken", "rail crack", or "rail surface anomaly".

3. The rail state monitoring apparatus according to claim 1, wherein the transmission antenna includes:

a first transmission antenna, which is disposed on the vehicle, and is configured to transmit the first electric signal to the first rail; and a second transmission antenna, which is disposed on the vehicle, and is configured to transmit the second electric signal to the second rail, wherein the reception antenna includes:

a first reception antenna, which is disposed on the vehicle, and is configured to receive the first electric signal propagated through the first rail and the second electric signal propagated through the annular transmission line; and a second reception antenna, which is disposed on the vehicle, and is configured to receive the second electric signal propagated through the second rail and the first electric signal propagated through the annular transmission line, and wherein the processor is further configured to:

calculate the received power of the first electric signal, which is received by the first reception antenna, and the received power of the second electric signal, which is received by the first reception antenna, and output the received powers as a first received power and a second received power, respectively;

calculate the received power of the first electric signal, which is received by the second reception antenna, and the received power of the second electric signal, which is received by the second reception antenna, and output the received powers as a third received power and a fourth received power, respectively;

classify each of the first received power, the second received power, the third received power, and the fourth received power as one of the three levels of "high", "medium, and "low" in comparison with the first threshold value and the second threshold value to generate a received power pattern; and determine each of the rail states of the first rail and the second rail as at least any one of "good", "rail broken", "rail crack", or "rail surface anomaly" based on the received power pattern, and output the result of the determination as the rail state information, wherein the processor is further configured to:

set a third threshold value in advance;

classify each of the received powers of the first electric signal and the second electric signal, which are received by the reception antenna, as one of two levels of "high" and "low" in comparison with the third threshold value to generate a second received power pattern; and determine whether an anomaly has occurred in the transmission antenna and the reception antenna based on the second received power pattern, and when an anomaly has occurred, output apparatus failure information for notifying that the anomaly has occurred.

4. The rail state monitoring apparatus according to claim 1, wherein the transmission antenna includes:

a first transmission antenna, which is disposed on the vehicle, and is configured to transmit the first electric signal to the first rail, wherein the reception antenna includes:

a first reception antenna, which is disposed on the vehicle, and is configured to receive the first electric signal propagated through the first rail; and a second reception antenna, which is disposed on the vehicle, and is configured to receive the first electric signal propagated through the annular transmission line, and wherein the processor is further configured to:

calculate the received power of the first electric signal, which is received by the first reception antenna, and output the received power as a first received power;

calculate the received power of the first electric signal, which is received by the second reception antenna, and output the received power as a second received power;

classify each of the first received power and the second received power as one of the three levels of "high", "medium, and "low" in comparison with the first threshold value and the second threshold value to generate a received power pattern; and determine each of the rail states of the first rail and the second rail as at least any one of "good", "rail broken", "rail crack", or "rail surface anomaly" based on the received power pattern, and output the result of the determination as the rail state information.

5. The rail state monitoring apparatus according to claim 1, wherein the transmission antenna includes:

a first transmission antenna, which is disposed on the vehicle, and is configured to transmit the first electric signal to the first rail; and a second transmission antenna, which is disposed on the vehicle, and is configured to transmit the second electric signal to the second rail, wherein the reception antenna includes a first reception antenna, which is disposed on the vehicle, and is configured to receive the first electric signal propagated through the first rail and the second electric signal propagated through the annular transmission line, and wherein the processor is further configured to:

calculate the received power of the first electric signal, which is received by the first reception antenna, and the received power of the second electric signal, which is received by the first reception antenna, and output the received powers as a first received power and a second received power, respectively;

classify each of the first received power and the second received power as one of the three levels of "high", "medium, and "low" in comparison with the first threshold value and the second threshold value to generate a received power pattern; and determine each of the rail states of the first rail and the second rail as at least any one of "good", "rail broken", "rail crack", or "rail surface anomaly" based on the received power pattern, and output the result of the determination as the rail state information.

6. The rail state monitoring apparatus according to claim 1, wherein the processor is further configured to store time-series data of the rail state information in a memory for each spot on the rail.

7. The rail state monitoring apparatus according to claim 1, wherein the processor is further configured to:

obtain a running distance in which the calculated received power is "low"; and determine each of the rail states of the first rail and the second rail as at least any one of "good", "rail broken", "rail crack", or "rail surface anomaly" based on the running distance and the received power pattern, and output the result of the determination as the rail state information.

8. The rail state monitoring apparatus according to claim 1, wherein the processor is further configured to transmit the rail state information to a ground apparatus disposed on a ground in a wireless manner.

9. The rail state monitoring apparatus according to claim 1, wherein the first electric signal received by the reception antenna includes:

a surface wave of the first electric signal propagated through the first rail; and a guided wave of the first electric signal propagated through the annular transmission line, and wherein the second electric signal received by the reception antenna includes:

a surface wave of the second electric signal propagated through the second rail; and a guided wave of the second electric signal propagated through the annular transmission line.

* * * * *